US011390992B2

(12) United States Patent
Oguchi et al.

(10) Patent No.: US 11,390,992 B2
(45) **Date of Patent: *Jul. 19, 2022**

(54) FIBER PROCESSING DEVICE, FIBROUS FEEDSTOCK RECYCLING DEVICE, AND CONTROL METHOD OF A FIBER PROCESSING DEVICE

(71) Applicant: SEIKO EPSON CORPORATION, Tokyo (JP)

(72) Inventors: Yuki Oguchi, Okaya (JP); Soichiro Seo, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 55 days.

This patent is subject to a terminal disclaimer.

(21) Appl. No.: 16/250,638

(22) Filed: Jan. 17, 2019

(65) Prior Publication Data

US 2019/0218713 A1 Jul. 18, 2019

(30) Foreign Application Priority Data

Jan. 18, 2018 (JP) ..... JP2018-006742

(51) Int. Cl.
*D21D 5/02* (2006.01)
*D21D 1/20* (2006.01)
(Continued)

(52) U.S. Cl.
CPC ..... *D21D 5/02* (2013.01); *D21C 5/02* (2013.01); *D21D 1/20* (2013.01); *D21D 5/06* (2013.01); *D21F 9/00* (2013.01)

(58) Field of Classification Search
CPC ... D21D 5/02; D21D 5/06; D21D 1/20; D21F 9/00; D21C 5/02; D21B 1/10; D21B 1/02
See application file for complete search history.

(56) References Cited

U.S. PATENT DOCUMENTS 4,215,447 A * 8/1980 Gartland ..... D21C 9/06 8/156
10,647,020 B2 5/2020 Oguchi et al.
(Continued)

FOREIGN PATENT DOCUMENTS

CN 205100028 U 3/2016
CN 106103825 A 11/2016
(Continued)

OTHER PUBLICATIONS

Jun. 27, 2019 Extended European Search Report issued in European Patent Application No. 19152544.3.
(Continued)

*Primary Examiner* — Eric Hug
*Assistant Examiner* — Elisa H Vera
(74) *Attorney, Agent, or Firm* — Oliff PLC

(57) ABSTRACT

Variation in the thickness of accumulated material is suppressed when material containing fiber is dispersed by the sieve and accumulated. A sheet manufacturing apparatus includes a drum that sieves defibrated material containing fiber, a first web former that accumulates first screened material discharged from the drum, and a processor that processes a first web accumulated in the first web former. During processing by the processor, the mesh belt operates at a first speed. When operation starts with the drum not operating, a startup operation including the mesh belt operating at a higher speed than the first speed in a first period after the drum starts is executed.

7 Claims, 14 Drawing Sheets

(51) Int. Cl.

| | |
|---|---|
| ***D21C 5/02*** | (2006.01) |
| ***D21F 9/00*** | (2006.01) |
| ***D21D 5/06*** | (2006.01) |

(56) References Cited

U.S. PATENT DOCUMENTS

| | | | | |
|---|---|---|---|---|
| 2009/0084711 | A1* | 4/2009 | Harju | D21D 5/06 209/270 |
| 2011/0174698 | A1 | 7/2011 | Bergstrom et al. | |
| 2011/0186254 | A1* | 8/2011 | Cabrera Y Lopez Caram | D21F 1/009 162/190 |
| 2012/0138250 | A1* | 6/2012 | Tamai | D21D 1/30 162/261 |
| 2014/0027075 | A1* | 1/2014 | Yamagami | D21B 1/063 162/4 |
| 2016/0273164 | A1* | 9/2016 | Omagari | D21B 1/068 |
| 2016/0332325 | A1 | 11/2016 | Murayama et al. | |
| 2017/0001330 | A1 | 1/2017 | Oguchi et al. | |
| 2019/0085509 | A1 | 3/2019 | Jaakkola et al. | |
| 2019/0218714 | A1 | 7/2019 | Oguchi et al. | |

FOREIGN PATENT DOCUMENTS

| | | | |
|---|---|---|---|
| DE | 3741791 | A1 | 6/1989 |
| EP | 3121322 | A1 | 1/2017 |
| JP | H07-59276 | B2 | 6/1995 |
| JP | 2016-124211 | A | 7/2016 |
| JP | 2016-169470 | A | 9/2016 |
| JP | 2017-154341 | A | 9/2017 |
| TW | 201536984 | A | 10/2015 |
| WO | 2018/043019 | A1 | 3/2018 |

OTHER PUBLICATIONS

U.S. Appl. No. 16/250,692, filed Jan. 17, 2019 in the name of Yuki Oguchi et al.
Apr. 28, 2021 Office Action issued in U.S. Appl. No. 16/250,692.
Jul. 19, 2021 Office Action issued in U.S. Appl. No. 16/250,692.
Nov. 9, 2021 Office Action issued in U.S. Appl. No. 16/250,692.

* cited by examiner

FIBER PROCESSING DEVICE, FIBROUS FEEDSTOCK RECYCLING DEVICE, AND CONTROL METHOD OF A FIBER PROCESSING DEVICE

This application claims the benefit of Japanese Patent Application No. 2018-006742 filed Jan. 18, 2018. The disclosure of the prior application is hereby incorporated by reference herein in its entirety.

BACKGROUND

1. Technical Field

The present invention relates to a fiber processing device, a fibrous feedstock recycling device, and a control method of a fiber processing device.

2. Related Art

A system for recycling feedstock containing fiber that executes a process of laying fiber in a web form is known from the literature. See, for example, JP-A-2017-154341, which describes dispersing material through holes in a sieve into air and accumulating the material on a mesh belt.

The configuration described in JP-A-2017-154341 disperses material through the holes in a sieve. Depending on the material that is dispersed and the state of the system in this configuration, the amount of material that passes through the holes in the sieve can vary greatly according to the operation of the sieve.

SUMMARY

This invention is directed to this problem, and an objective of the invention is to suppress variation in the thickness of the accumulated material when material containing fiber is dispersed by the sieve and accumulated.

To achieve the foregoing objective, a fiber processing device according to the invention has a sieve configured to screen material containing fiber; an accumulator configured to accumulate the material discharged from the sieve; and a processor configured to process the material accumulated on the accumulator. The fiber processing device operates the accumulator at a first speed during processing by the processor; and when starting from a state in which the sieve is stopped, executes a startup operation including a state in which the accumulator operates at a higher speed than the first speed in a first period after the sieve starts.

By operating the accumulator at a high speed, this configuration suppresses increasing the thickness of the material accumulated on the accumulator even if the amount of material discharged from the sieve increases.

In a fiber processing device according to another aspect of the invention, in the first period, the accumulator maintains a state of operating at a higher speed than the first speed.

In a fiber processing device according to another aspect of the invention, the accumulator has a receiver on which the material can accumulate in a sheet, and the receiver moves on a circulating path.

In a fiber processing device according to another aspect of the invention, during processing by the processor, the receiver operates at the first speed, and in the first period the operating speed of the receiver is maintained at a second speed greater than the first speed.

In a fiber processing device according to another aspect of the invention, when starting from a state in which the sieve is stopped, before the sieve starts, the operating speed of the receiver accelerates to a higher speed than the first speed, and in a second period after acceleration ends, a state in which the receiver operates at a higher speed than the first speed is maintained.

In a fiber processing device according to another aspect of the invention, when starting from a state in which the sieve is stopped, the startup operation executes with the material in the sieve.

In a fiber processing device according to another aspect of the invention, the sieve moves at a third speed and discharges the material from the sieve during processing by the processor; and when starting from a state in which the sieve is stopped, includes a state in the first period when the sieve operates at a different speed than the third speed.

In a fiber processing device according to another aspect of the invention, the sieve is cylindrical, openings are disposed in the outside surface of the sieve, and the sieve rotates on an axis of the cylinder.

Another aspect of the invention is a fibrous feedstock recycling device including a refiner configured to refine material containing fiber; a sieve configured to screen refined material acquired from the refiner; an accumulator configured to accumulate the refined material discharged from the sieve; and a processor configured to process the refined material accumulated on the accumulator. The accumulator operates at a first speed during processing by the processor, and when starting from a state in which the sieve is stopped, a startup operation including a state in which the accumulator operates at a higher speed than the first speed in a first period after the sieve starts executes.

By operating the accumulator at a high speed in the startup operation, this configuration suppresses increasing the thickness of the material accumulated on the accumulator even if the amount of material discharged from the sieve increases.

Another aspect of the invention is a control method of a fiber processing device including a sieve configured to screen material containing fiber, an accumulator configured to accumulate the material discharged from the sieve, a processor configured to process the material accumulated on the accumulator, and a driver configured to operate the accumulator to convey the material accumulated on the accumulator to the processor. The control method causes the accumulator to operate at a first speed during processing by the processor; and when starting from a state in which the sieve is stopped, causes the driver to execute a startup operation including a state in which the accumulator operates at a higher speed than the first speed in a first period after the sieve starts.

By operating the accumulator at a high speed in the startup operation, this configuration suppresses increasing the thickness of the material accumulated on the accumulator even if the amount of material discharged from the sieve increases.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the invention are described below with reference to the accompanying figures. Note that the embodiments described below do not limit the content of the embodiment described in the accompanying claims. All configurations described below are also not necessarily essential elements of the invention.

1. Embodiment 1

1. General Configuration of a Sheet Manufacturing Apparatus

Figure 1:
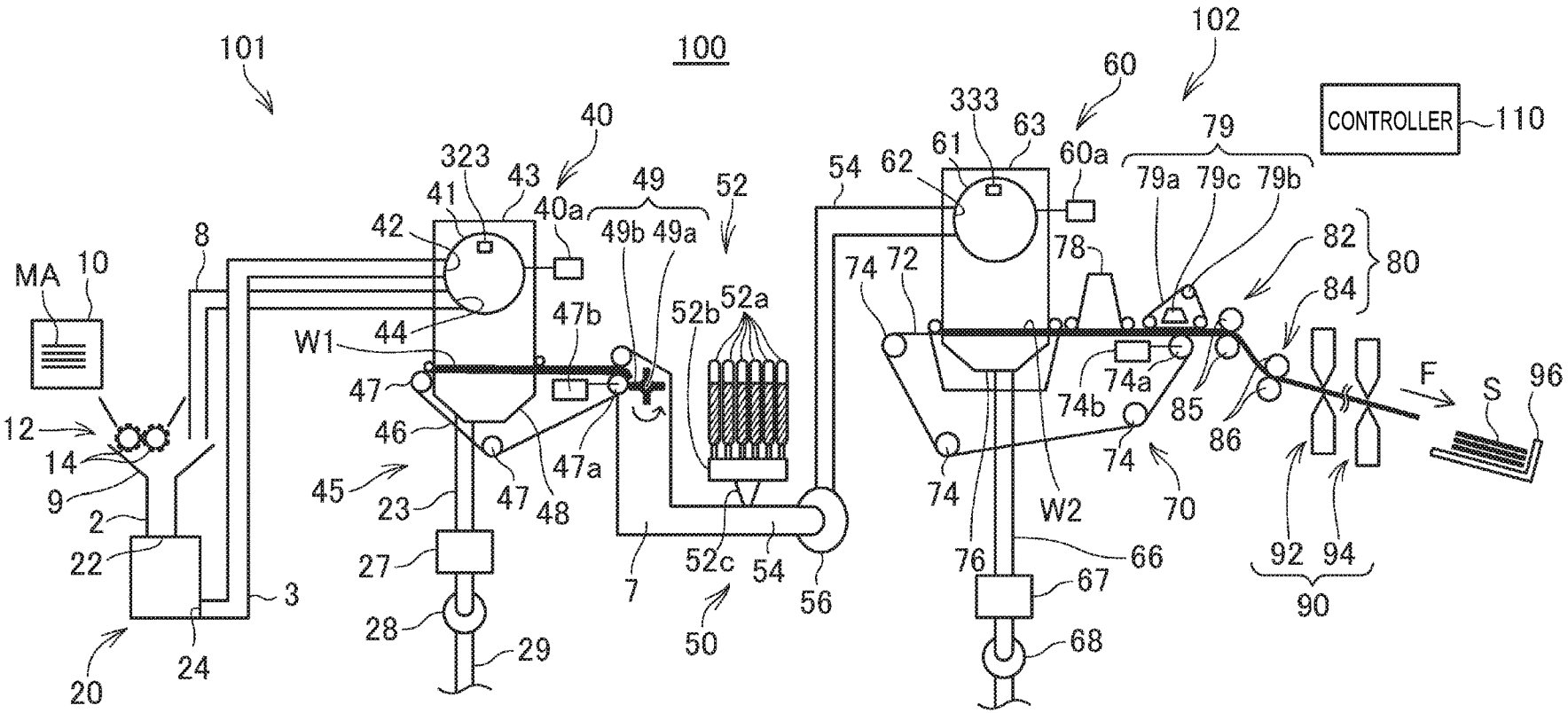
FIG. 1 illustrates the configuration of a sheet manufacturing apparatus.

FIG. 1 schematically illustrates the configuration of a sheet manufacturing apparatus 100 according to the invention.

The sheet manufacturing apparatus 100 executes a recycling process of extracting fiber from a feedstock material MA containing fiber and making new sheets S from the fiber. The sheet manufacturing apparatus 100 can make multiple types of sheets S, and by mixing additives with the feedstock material MA according to the application of the sheets S, can adjust the paper strength and whiteness, or add color, scents, or functions such as fire retardancy to the sheets S. The sheet manufacturing apparatus 100 can also adjust the density, thickness, size, and shape of the sheets S. Typical examples of the sheets S include office paper in standard sizes such as A4 or A3, various kinds of sheet products such as cleaning sheets for cleaning flooring, sheets for cleaning up oil and grease, and sheets cleaning toilets, as well as paper plates and other products. The sheet manufacturing apparatus 100 is an example of a fibrous feedstock recycling device and a fiber processing device according to the invention.

The sheet manufacturing apparatus 100 includes a feedstock feeder 10, shredder 12, defibrator 20, classifier 40, first web former 45, rotor 49, mixing device 50, air-laying device 60, second web former 70, conveyor 79, sheet former 80, and sheet cutter 90. The shredder 12, defibrator 20, classifier 40, and first web former 45 configure a defibration processor 101 that defibrates the feedstock material MA and acquires material used to make the sheets S. The rotor 49, mixing device 50, air-laying device 60, second web former 70, sheet former 80, and sheet cutter 90 configure a sheet maker 102 that processes the material acquired by the defibration processor 101 and makes sheets S.

The feedstock feeder 10 in this example is an automatic sheet feeder that holds and continuously supplies the feedstock material MA to the shredder 12. The feedstock material MA may be an material containing fiber, such as recovered paper, waste paper, and pulp sheets.

The shredder 12 has shredder blades 14 that cut the feedstock material MA supplied by the feedstock feeder 10, shreds the feedstock material MA in air by the shredder blades 14, and produces paper shreds a few centimeters square. The shape and size of the shreds is not specifically limited. A paper shredder, for example, may be used as the shredder 12. The feedstock material MA shredded by the shredder 12 is then collected in a hopper 9, and conveyed through a conduit 2 to the defibrator 20.

The defibrator 20 defibrates the coarse shreds produced by the shredder 12. Defibration is a process of breaking feedstock material MA containing bonded fibers into single fibers or a few intertwined fibers. The feedstock material MA may also be referred to as material to defibrate or defibration material. By the defibrator 20 defibrating the feedstock material MA, resin particles, ink, toner, bleeding inhibitors, and other materials included in the feedstock material MA can be expected to also separate from the fibers. The material that has past through the defibrator 20 is referred to as defibrated material.

In addition to defibrated fibers that have been separated, the defibrated material may contain additives that are separated from the fiber during defibration, including resin, ink, toner, and other color additives, bleeding inhibitors, and paper strengthening agents. The resin particles contained in the defibrated material is resin that is mixed to bind fibers together when the feedstock material MA was manufactured. The shape of the fiber in the defibrated material may be as strings or ribbons. The fiber contained in the defibrated material may be as individual fibers not intertwined with other fibers, or as clumps, which are multiple fibers tangled with other defibrated material into clumps. The defibrator 20 is an example of a refiner. The defibrated material MB described below is an example of refined material.

The defibrator 20 defibrates in a dry process. A dry process as used herein means that the defibration process is done in air instead of a wet solution. The defibrator 20 uses a defibrator such as an impeller mill in this example. More specifically, the defibrator 20 has a rotor (not shown in the figure), and a liner (not shown in the figure) positioned around the outside of the rotor, and the shreds go between the rotor and the liner and are defibrated.

The shreds are conveyed by an air current from the shredder 12 to the defibrator 20. This air current may be generated by the defibrator 20, or the air current may be produced by a blower (not shown in the figure) disposed upstream or downstream from the defibrator 20 in the conveyance direction of the shreds and defibrated material. The defibrated material is carried by the air current from the defibrator 20 through a conduit 3 to the classifier 40. The air current conveying the defibrated material to the classifier 40 may be generated by the defibrator 20 or the air current from the blower described above may be used.

The classifier 40 separates the components of the defibrated material defibrated by the defibrator 20 by the size of the fiber. The size of the fiber primarily indicates the length of the fiber. The classifier 40 has an inlet 42 through which defibrated material is introduced to the drum 41, and an exit 44 from which second screened material described below is discharged from the drum 41. The exit 44 connects to the defibrator 20 through a conduit 8, and the classifier 40 returns the second screened material through the conduit 8 to the defibrator 20.

The first web former 45 forms a first web W1 by forming the material separated by the classifier 40 into a web.

Figure 2:
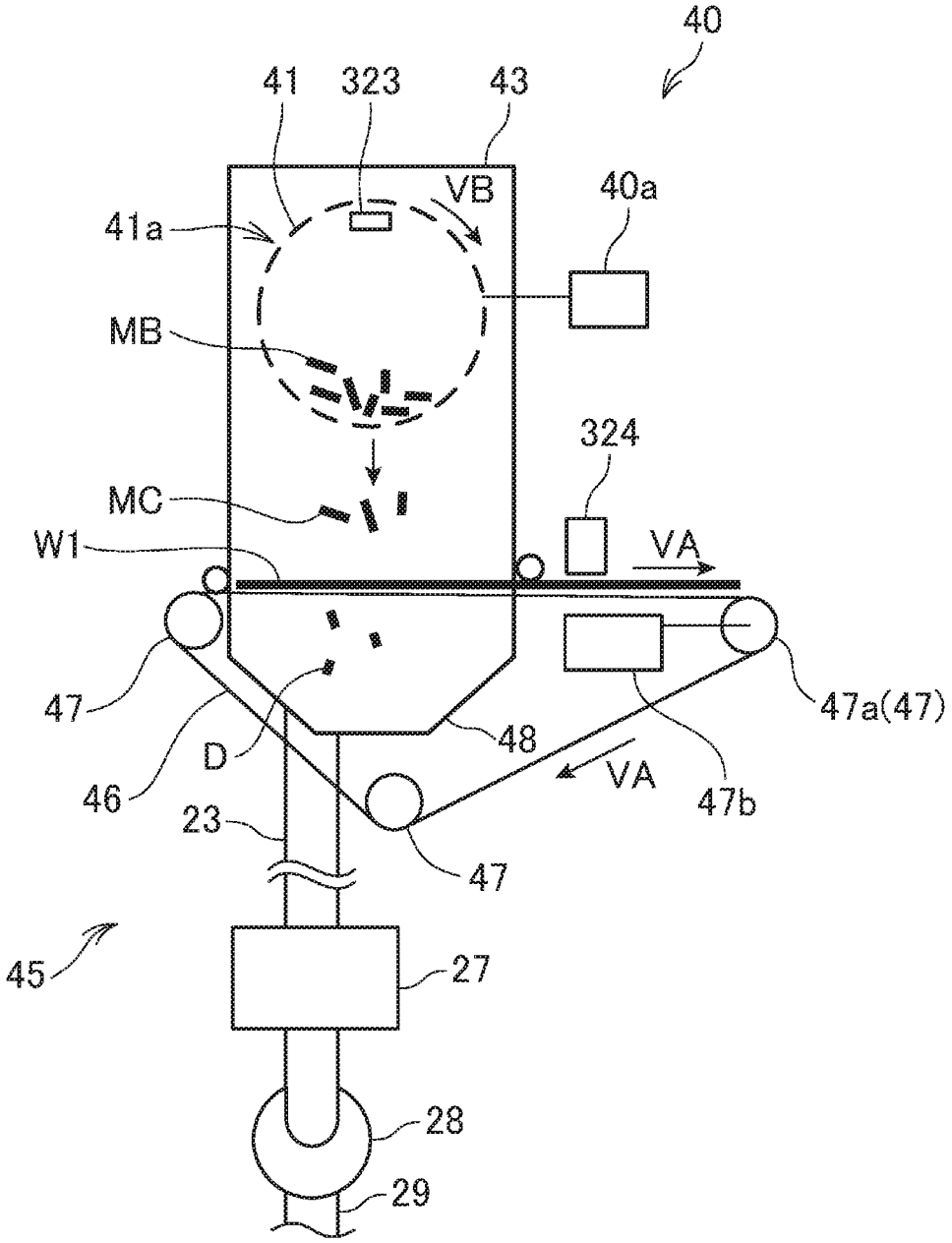
FIG. 2 illustrates the basic configuration of a classifier and first web former.

FIG. 2 shows the basic configuration of the classifier 40 and first web former 45, and shows the main parts thereof from the side.

As shown in FIG. 1 and FIG. 2, the classifier 40 includes a drum 41, and a housing 43 around the drum 41.

The drum 41 in this example is configured with a sieve. More specifically, the drum 41 has mesh, a filter or a screen with openings that functions as a sieve. More specifically, the drum 41 is cylindrical, and is rotationally driven centered on the axis of the cylinder by a first sieve motor 40*a* (driver, sieve driver). At least part of the circumferential surface of the drum 41 is mesh. The mesh of the drum 41 may be a metal screen, expanded metal made by expanding a metal sheet with slits formed therein, or punched metal, for example. In FIG. 2, reference numeral 41*a* indicates the openings in the drum 41. The operating speed at which the drum 41 operates by driving the first sieve motor 40*a* is speed VB. This speed VB is also referred to as the rotational speed of the drum 41. Note that the direction of rotation of the drum 41 is not limited to the direction shown in FIG. 2, and the drum 41 may be driven in reverse, or driven bidirectionally by the first sieve motor 40*a* alternating the direction of rotation. In addition, speed VB is not limited to the speed in the direction indicated by the arrow in FIG. 2, and may indicate the speed of the drum 41 relative to when the drum 41 is not turning.

The drum 41 is an example of a sieve according to the invention. The defibrated material MB that is fed into the drum 41, and the first screened material MC that is sieved through the openings 41*a*, are examples of material.

The first web former 45 includes a mesh belt 46, tension rollers 47, and a suction device 48. The mesh belt 46 is an endless metal belt, and is mounted around multiple tension rollers 47. The mesh belt 46 circulates in a path configured by the tension rollers 47. Part of the path of the mesh belt 46 is flat in the area below the drum 41, and the mesh belt 46 forms a flat surface.

One of the tension rollers 47 is a drive roller 47*a* that drives the mesh belt 46. The drive roller 47*a* turns as driven by a first belt motor 47*b*, and drives the mesh belt 46 in the direction indicated by the arrow in the figure. The operating speed at which the mesh belt 46 operates by the drive power of the first belt motor 47*b* is speed VA. This speed VA is also referred to as the conveyance speed of the mesh belt 46.

A servo motor, stepper motor, or other known type of motor may be used for the first sieve motor 40*a* and first belt motor 47*b*. Gears, links, or other transfer mechanisms that transfer power may also be disposed between the first sieve motor 40*a* and drum 41, and between the drive roller 47*a* and first belt motor 47*b*.

The defibrated material MB introduced from the inlet 42 to the inside of the drum 41 is separated by rotation of the drum 41 into screened material that past through the openings 41*a* of the drum 41, and remnants that do not pass through the openings 41*a*. The screened material that past through the openings 41*a* includes fiber or particles that are smaller than the openings 41*a*, and is referred to below as first screened material MC. The remnants include, for example, fibers, undefibrated shreds, and clumps that are larger than the openings 41*a*, and are referred to as second screened material below. The first screened material MC descends inside the housing 43 and falls onto the first web former 45. As described above, the second screened material is conveyed from the exit 44 through conduit 8 to the defibrator 20.

By rotation of the drum 41, the first screened material MC that passes through the openings 41*a* descends inside the housing 43 to the mesh belt 46. Numerous openings are also formed in the mesh belt 46. Of the first screened material MC that descends from the drum 41, components that are larger than the openings in the mesh belt 46 accumulate on the mesh belt 46. Components of the first screened material MC that are smaller than the openings in the mesh belt 46 pass through the openings. The components that pass through the openings in the mesh belt 46 are referred to as third screened material D. The third screened material D contains fibers in the defibrated material that are shorter than the openings in the mesh belt 46, as well as resin particles, and particles of ink, toner, bleeding inhibitors and other material that is separated from the fibers by the defibrator 20. The first web former 45 in this example is an example of an accumulator according to the invention, and the mesh belt 46 is an example of a receiver in the invention. The first sieve motor 40*a* is an example of a sieve driver, and the first belt motor 47*b is an example of a driver.*

The suction device 48 pulls air from below the mesh belt 46. The suction device 48 is connected through a conduit 23 to a first dust collector 27. The first dust collector 27 has a filter for separating the third screened material D from the air current. Downstream from the first dust collector 27 is a first collection blower 28, and the first collection blower 28 suctions air from the first dust collector 27.

This configuration suctions small third screened material D from the first screened material MC that descended to the mesh belt 46 by the suction of the first collection blower 28, and collects the third screened material D by the filter of the first dust collector 27. The air that passes through the filter of the first dust collector 27 is discharged from a conduit 29.

Because the air current suctioned by the suction device 48 pulls the first screened material MC descending from the drum 41 to the mesh belt 46, the air current has the effect of promoting accumulation of the first screened material MC. The first screened material MC accumulated on the mesh belt 46 accumulates in a web, forming a first web W1.

Of the components of the first screened material MC, the first web W1 comprises mainly fibers that are larger than the openings in the mesh belt 46, and is a fluffy web containing much air. The first web W1 is conveyed by movement of the mesh belt 46 to the rotor 49.

Referring again to FIG. 1, the rotor 49 has a base 49*a* connected to a driver such as a motor (not shown in the figure), and fins 49*b* protruding from the base 49*a*, and when the base 49*a* turns indirection of rotation R indicated by the arrow, the fins 49*b* rotate around the base 49*a*. The fins 49*b* in this example are flat blades. In the example in FIG. 1, there are four fins 49*b* disposed equidistantly around the base 49*a*.

The rotor 49 is disposed at the end of the flat part of the path of the mesh belt 46. Because the path of the mesh belt 46 curves down at this end, the mesh belt 46 also curves and moves down. As a result, the first web W1 conveyed by the mesh belt 46 extends forward from the mesh belt 46 and contacts the rotor 49. The first web W1 is then broken up by the fins 49*b* striking the first web W1, and reduced to small clumps of fiber. These clumps then travel through the conduit 7 located below the rotor 49, and are conveyed to the mixing device 50. Because the first web W1 is a soft, fluffy structure of fiber accumulated on the mesh belt 46 as described above, the first web W1 is easily broken up by collision with the rotor 49.

The rotor 49 is positioned so that the fins 49*b* can contact the first web W1 but the fins 49*b* do not touch the mesh belt 46. The distance between the fins 49*b* and the mesh belt 46 at the closest point is preferably greater than or equal to 0.05 mm and less than or equal to 0.5 mm.

The mixing device 50 mixes the first screened material with an additive. The mixing device 50 has an additive supplier 52 that supplies an additive, a conduit 54 through which the first screened material MC and additive flow, and a mixing blower 56.

One or more additive cartridges 52*a* storing additives are installed to the additive supplier 52. The additive cartridges 52*a* may be removably installed to the additive supplier 52. The additive supplier 52 includes an additive extractor 52*b* that extracts additive from the additive cartridges 52*a*, and an additive injector 52*c* that injects the additive extracted by the additive extractor 52*b* into the conduit 54.

The additive extractor 52*b* has a feeder (not shown in the figure) that feeds additive in a powder or particulate form from inside the additive cartridges 52*a*, and removes additive from some or all of the additive cartridges 52*a*. The additive removed by the additive extractor 52*b* is conveyed to the additive injector 52*c*.

The additive injector 52*c* holds the additive removed by the additive extractor 52*b*. The additive injector 52*c* has a shutter (not shown in the figure) that opens and closes the connection to the conduit 54, and when the shutter is open, the additive extracted by the additive extractor 52*b* is fed into the conduit 54.

The additive supplied from the additive supplier 52 includes resin (binder) that binds multiple fibers together when heated. The resin contained in the additive melts when passing through the sheet former 80 and binds multiple fibers together. The resin may be a thermoplastic resin or thermoset resin, such as AS resin, ABS resin, polypropylene, polyethylene, polyvinyl chloride, polystyrene, acrylic resin, polyester resin, polyethylene terephthalate, polyethylene ether, polyphenylene ether, polybutylene terephthalate, nylon, polyimide, polycarbonate, polyacetal, polyphenylene sulfide, and polyether ether ketone. These resins may be used individually or in a desirable combination.

The additive supplied from the additive supplier 52 may contain components other than resin for binding fibers. For example, depending on the type of sheet being manufactured, the additive also include a coloring agent for coloring the fiber, an anti-blocking agent to prevent agglomeration of fibers and agglomeration of resin, or a flame retardant for making the fiber difficult to burn. The additive may also be in the form of fibers or particles.

The mixing blower 56 produces an air current flowing through a conduit 54 connecting 7 to the air-laying device 60. The first screened material MC conveyed from the 7 into the conduit 54, and the additive supplied by the additive supply device 52 to the conduit 54, are mixed as they pass through the mixing blower 56.

The mixing blower 56 in this example can be configured with a motor (not shown in the figure), blades (not shown in the figure) that turn as driven by the motor, and a case (not shown in the figure) housing the blades, and may be a configuration in which the blades and case are connected. In addition, to blades for producing an air current, the mixing blower 56 may also include a mixer for mixing the first screened material and the additive. The mixture combined by the mixing device 50 is then conveyed by the air current produced by the mixing blower 56 to the air-laying device 60, and introduced through the inlet 62 to the air-laying device 60.

The air-laying device 60 detangles and causes the fibers in the mixture to disperse in air while precipitating to the second web former 70. If the additive supplied from the additive supply device 52 is fibrous, these additive fibers are also detangled by the air-laying device 60 and descend to the second web former 70. The second web former 70 accumulates the mixture precipitating from the air-laying device 60, forming a second web W2.

Figure 3:
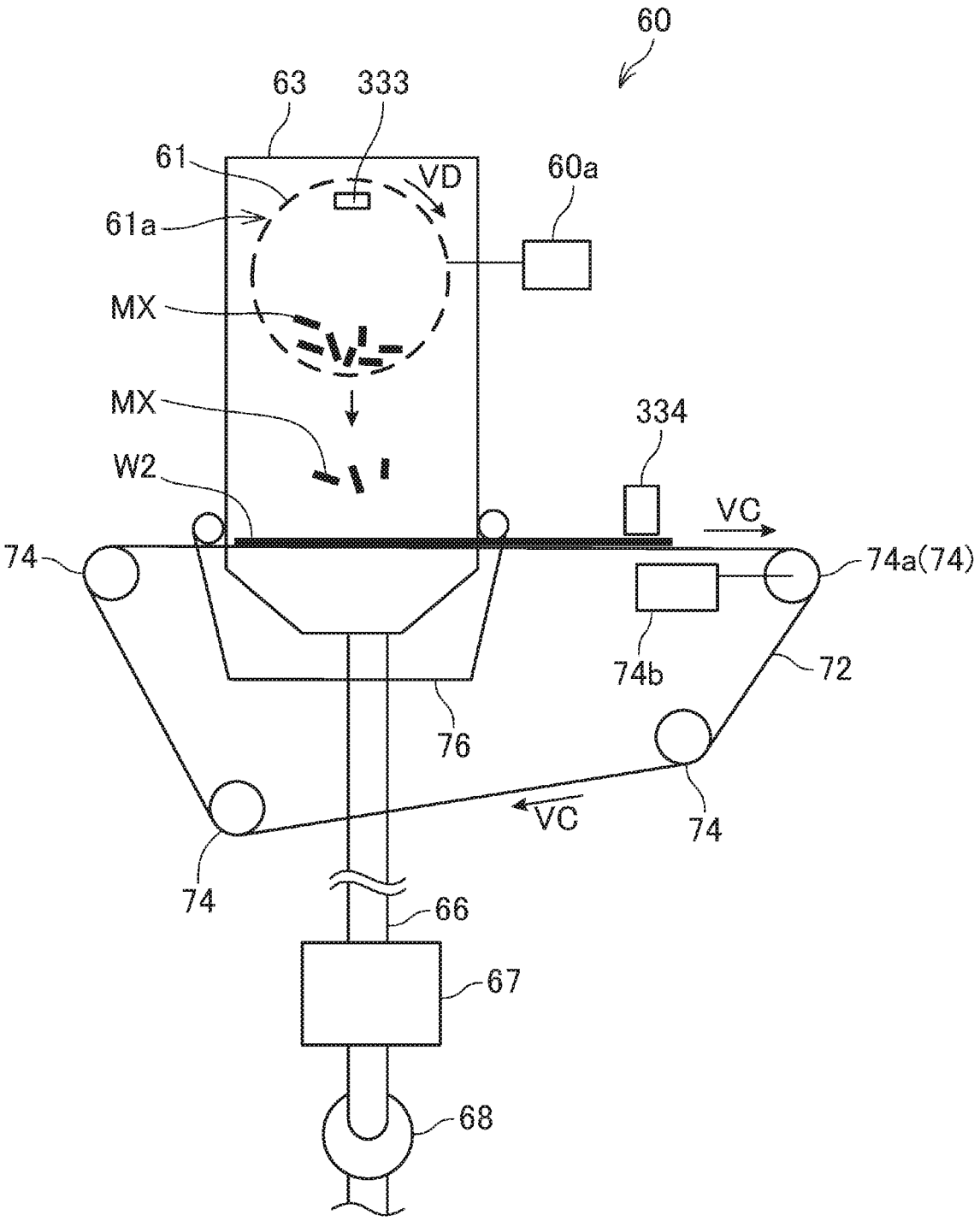
FIG. 3 illustrates the basic configuration of an accumulator and second web former.

FIG. 3 shows the basic configuration of the air-laying device 60 and second web former 70, and shows the main parts thereof from the side.

As shown in FIG. 1 and FIG. 3, the air-laying device 60 includes a drum 61, and a housing 63 around the drum 61.

The air-laying device 60 includes a drum 61, and a housing 63 that houses the drum 61. The drum 61 is configured as a cylindrical structure.

Like the drum 41 described above, drum 61 in this example is configured with a sieve. More specifically, the drum 61 has mesh, a filter or a screen with openings that functions as a sieve. More specifically, the drum 61 is cylindrical, and is rotationally driven centered on the axis of the cylinder by second sieve motor 60*a* (driver, sieve driver). At least part of the circumferential surface of the drum 61 is mesh. The mesh of the drum 61 may be a metal screen, expanded metal made by expanding a metal sheet with slits formed therein, or punched metal, for example. The openings in the drum 61 are identified as holes 61*a*. The drum 61 turns as driven by the second sieve motor 60*a*, functions as a sieve, and the mixture detangled by rotation of the drum 61 passes through the holes 61*a* and descends. The mixture that passes through the inlet 62 is referred to as mixture MX below.

The operating speed at which the drum 61 operates by driving the second sieve motor 60*a* is speed VD. This speed VD is also referred to as the rotational speed of the drum 61. Note that the direction of rotation of the drum 61 is not limited to the direction shown in FIG. 3, and the drum 61 may be driven in reverse, or driven bidirectionally by the second sieve motor 60*a* alternating the direction of rotation. In addition, speed VD is not limited to the speed in the direction indicated by the arrow in FIG. 3, and may indicate the speed of the drum 61 relative to when the drum 61 is not turning.

The second web former 70 is located below the drum 61. The second web former 70 in this example includes a mesh belt 72, tension rollers 74, and a suction mechanism 76.

The mesh belt 72 is an endless metal belt similar to the mesh belt 46 described above, and is mounted around multiple tension rollers 74. The mesh belt 72 circulates in a path configured by the tension rollers 74. Part of the path of the mesh belt 72 is flat in the area below the drum 61, and the mesh belt 72 forms a flat surface. There are also many holes in the mesh belt 72.

One of the tension rollers 74 is a drive roller 74*a* that drives the mesh belt 72. The drive roller 74*a* turns as driven by a second belt motor 74*b*, and drives the mesh belt 74 in the direction indicated by the arrow in the figure. The operating speed at which the mesh belt 74 operates by the drive power of the second belt motor 74*b* is speed VC. This speed VC is also referred to as the conveyance speed of the mesh belt 72.

A servo motor, stepper motor, or other known type of motor may be used for the second sieve motor 60*a* and second belt motor 74*b*. Gears, links, or other transfer mechanisms that transfer power may also be disposed between the second sieve motor 60*a* and drum 61, and between the drive roller 74*a* and second belt motor 74*b*.

The mixture MX inside the drum 61 passes through the holes 61*a* by rotation of the drum 61, and descends to the mesh belt 72. Of the mixture MX descending from the drum 61, components larger than the holes in the mesh belt 72 accumulate on the mesh belt 72. Components of the mixture that are smaller than the holes in the mesh belt 72 pass through the holes.

A suction mechanism 76 is connected to a conduit 66. The conduit 66 is connected through a second dust collector 67 to the second collection blower 68. The second dust collector 67 has a filter that collects particles and fiber that pass through the mesh belt 72. The second collection blower 68 is a blower that suctions air through the conduit 66, and discharges the suctioned air outside the sheet manufacturing apparatus 100 or to a specific place in the sheet manufacturing apparatus 100.

The suction mechanism 76 pulls air from below the mesh belt 72 by the suction of the second collection blower 68, and collects particles and fiber contained in the suctioned air by the second dust collector 67. The air current suctioned by the second collection blower 68 pulls the mixture descending from the drum 61 to the mesh belt 72, and has the effect of promoting accumulation of the mixture on the mesh belt 72. The air current suctioned by the suction device 48 creates a down flow in the path of the mixture descending from the drum 61, and can be expected to have the effect of preventing the precipitating fibers from becoming tangled. The mixture MX accumulated on the support surface 71 is laid in a web on the flat part of the mesh belt 72, forming a second web W2.

Referring again to FIG. 1, a wetting device 78 is disposed to the conveyance path of the mesh belt 72 downstream from the air-laying device 60. The wetting device 78 is a mist humidifier that produces and supplies a water mist to the mesh belt 72. The wetting device 78 in this example has a tank that holds water, and an ultrasonic vibrator that converts the water to mist. Because the moisture content of the second web W2 can be adjusted by the mist supplied by the wetting device 78, the mist can be expected to suppress accretion of fiber on the mesh belt 72 due to static electricity.

The second web W2 is then conveyed by the conveyor 79, separates from the mesh belt 72, and is conveyed to the sheet former 80. The conveyor 79 in this example has a mesh belt 79*a*, rollers 79*b*, and a suction mechanism 79*c*. The suction mechanism 79*c* has a blower (not shown in the figure), and produces an air current upward through the mesh belt 79*a* by the suction of the blower. The second web W2 is separated from the mesh belt 72 and pulled to the mesh belt 79*a* by this air current. The mesh belt 79*a* moves by rotation of the rollers 79*b*, and conveys the second web W2 to the sheet former 80.

By applying heat to the second web W2, the sheet former 80 binds fibers recovered from the first screened material and contained in the second web W2 through the resin contained in the additive.

The sheet former 80 has a compression device 82 that compresses the second web W2, and a heating device 84 that heats the second web W2 after compression by the compression device 82.

The compression device 82 comprises a pair of calender rolls 85. The compression device 82 has a hydraulic press mechanism (not shown in the figure) that applies nip pressure to the calender rolls 85, and a motor or other driver (not shown in the figure) that causes the calender rolls 85 to rotate in the direction of the heating device 84. The compression device 82 compresses and conveys the second web W2 to the heating device 84 with a specific nip pressure by the calender rolls 85.

The heating device 84 includes a pair of heat rollers 86. The heating device 84 also has a heater (not shown in the figure) that heats the surface of the heat rollers 86 to a specific temperature, and a motor or other driver (not shown in the figure) that causes the heat rollers 86 to rotate in the direction of the sheet cutter 90. The heating device 84 holds and heats the second web W2 compressed to a high density by the compression device 82, and conveys the heated second web W2 to the sheet cutter 90. The second web W2 is heated in the heating device 84 to a temperature greater than the glass transition temperature of the resin contained in the second web W2, forming a sheet S.

The sheet cutter 90 cuts the sheet S formed by the sheet former 80. In this example, the sheet cutter 90 has a first cutter 92 that cuts the sheet S crosswise to the conveyance direction of the sheet S indicated by the arrow F in the figure, and a second cutter 94 that cuts the sheet S parallel to the conveyance direction F. The sheet cutter 90 cuts the length and width of the sheet S to a specific size, forming single sheets. The single sheets S cut by the sheet cutter 90 are then stored in the discharge tray 96. The discharge tray 96 may be a tray or stacker for holding the manufactured sheets, and the sheets S discharged to the tray can be removed and used by the user.

Parts of the sheet manufacturing apparatus 100 embody a defibration processor 101 and a sheet maker 102. The defibration processor 101 includes at least the defibrator 20, and may include the classifier 40 and first web former 45.

The defibration processor 101 makes defibrated material from feedstock material MA, or forms the defibrated material into a web configuration to make a first web W1. The work product of the defibration processor 101 may be conveyed through the rotor 49 to the mixing device 50, or removed from the sheet manufacturing apparatus 100 without passing through the rotor 49 and stored. This work product can also be sealed in specific packages in a form ready for shipping or sale.

The sheet maker 102 is a functional device for making the work product manufactured by the defibration processor 101 into sheets S, and may be referred to as a processor. The sheet maker 102 includes the mixing device 50, air-laying device 60, second web former 70, conveyor 79, sheet former 80 and sheet cutter 90, and may also include the rotor 49. The sheet maker 102 may also include the additive supply device 52.

The sheet manufacturing apparatus 100 may be configured with the defibration processor 101 and sheet maker 102 as a single integrated system, or with the defibration processor 101 and sheet maker 102 separate. In this case, the defibration processor 101 is an example of a fibrous feedstock recycling device according to the invention. The sheet maker 102 is an example of a sheet forming device that processes defibrated material into sheets. Each of these components may also be conceived of as processing devices.

1-2. First Web W1 Forming Conditions

The forming conditions of the first web W1 formed by the first web former 45 are described below with reference to FIG. 2.

The thickness of the first web W1 is determined by the amount of first screened material MC, which is the material supplied to the mesh belt 46, and the amount of movement of the mesh belt 46 per unit time. The amount of movement of the mesh belt 46 per unit time is speed VA shown in the figure.

One factor determining the amount of first screened material MC supplied to the mesh belt 46, that is, the amount of first screened material MC passing through the openings 41*a*, is the speed VB of the drum 41. As speed VB increases, the defibrated material MB is more quickly defibrated in the drum 41, and the first screened material MC passes more easily through the openings 41*a*. In addition, the greater the speed VB, the more easily the first screened material MC passes the openings 41*a*. Therefore, the amount of first screened material MC passing the openings 41*a* increases as the speed VB increases.

The amount of first screened material MC passing the openings 41*a* changes when the drum 41 starts moving from a stop. Because rotation of the drum 41 produces friction between the fibers of the first screened material MC inside the drum 41, the first screened material MC also becomes charged. If the first screened material MC agglomerates due to this static electricity, it becomes more difficult for the first screened material MC to pass the openings 41*a*.

On the other hand, when the drum 41 is stopped, the charge of the charged first screened material MC is discharged, and clumps of fiber in the first screened material MC break apart. Therefore, when the drum 41 starts turning from a stop, that is, when the drum 41 starts operating, the first screened material MC passes easily through the openings 41*a*. The amount of first screened material MC passing the openings 41*a* therefore temporarily increases at this time.

The amount of first screened material MC passing the openings 41*a* is also affected by the humidity in the drum 41. Humidity as used here can be referred to as relative humidity (RH). If the humidity inside the drum 41 is high, charging of the fibers in the first screened material MC is reduced, fiber agglomeration is suppressed, and the volume of fiber clumps to be broken up is low. Therefore, the higher the humidity inside the drum 41, the less variation there is in the amount of first screened material MC passing the openings 41*a*.

In addition, if the humidity inside the drum 41 is low, reducing charging of the fibers in the first screened material MC is more difficult, fiber agglomeration increases greatly, and the volume of fiber clumps to be broken up is great. Therefore, the lower the humidity inside the drum 41, the greater the variation is in the amount of first screened material MC passing the openings 41*a*.

The amount of first screened material MC passing the openings 41*a* also varies according to the length of the fiber in the first screened material MC. Short fibers pass through the openings 41*a* easily. Therefore, the shorter the fibers in the first screened material MC, the greater the amount of first screened material MC that passes the openings 41*a*.

The greatest factor determining the amount of first screened material MC supplied from the drum 41 to the mesh belt 46 is therefore the speed VB of the drum 41. Factors that change the amount of first screened material MC include whether or not the drum 41 is starting up, the humidity inside the drum 41, and the length of fiber in the first screened material MC.

If the thickness of the first web W1 varies, the amount of material supplied to processes downstream from the first web former 45 may vary, affecting the quality of the sheets S manufactured by the sheet manufacturing apparatus 100.

The controller 150 of the sheet manufacturing apparatus 100 therefore executes a control process that suppresses variation in the thickness of the first web W1.

To execute control related to the thickness of the first web W1, the sheet manufacturing apparatus 100 has a first belt speed detector 322 (FIG. 4) for detecting the speed VA, and a first sieve speed detector 321 (FIG. 4) for detecting speed VB.

The sheet manufacturing apparatus 100 can also detect the humidity inside the drum 41. For example, in this configuration the sheet manufacturing apparatus 100 has a first temperature/humidity detector 323 (humidity detector). The first temperature/humidity detector 323 can be configured by a sensor unit having a temperature sensor and a humidity sensor. The temperature sensor may be a thermistor, resistance temperature detector, thermocouple, or IC temperature sensor, for example. The humidity sensor may be any configuration capable of detecting relative humidity, such as a resistance humidity sensor or a capacitance humidity sensor. The first temperature/humidity detector 323 detects the temperature and the relative humidity of the space inside the drum 41. The first temperature/humidity detector 323 may output the temperature and humidity detection values as analog signal or as digital data indicating the detected values. The detected temperature and detected humidity may also be output as a combined value.

The sheet manufacturing apparatus 100 also has a first thickness detector 324. The first thickness detector 324 is a sensor that detects the thickness of the first web W1. For example, the first thickness detector 324 may be an optical thickness sensor that has a light source and a photosensor, emits light to the first web W1, and detects the amount of light passing the first web W1 to detect the thickness of the first web W1. The first thickness detector 324 may also be a contact thickness sensor having a probe that contacts the first web W1, and an encoder that detects the position of the probe, and detects the distance between the surface of the first web W1 and the surface of the mesh belt 46. The first thickness detector 324 may also be an ultrasonic thickness sensor, or a sensor that detects thickness by another method.

The controller 110 may also control adjusting the thickness of the first web W1 based on the output of the first thickness detector 324. For example, if the thickness detected by the first thickness detector 324 is outside a predetermined range, the controller 110 may stop the sheet manufacturing apparatus 100 or issue a warning.

1-3. Second Web Former Configuration

As shown in FIG. 3, the sheet manufacturing apparatus 100 may also have a second temperature/humidity detector 333 as a configuration for detecting the humidity inside the drum 61. Like the first temperature/humidity detector 323, the second temperature/humidity detector 333 can be configured by a sensor unit having a temperature sensor and a humidity sensor. The temperature sensor may be a thermistor, resistance temperature detector, thermocouple, or IC temperature sensor, for example. The humidity sensor may be any configuration capable of detecting relative humidity, such as a resistance humidity sensor or a capacitance humidity sensor. The second temperature/humidity detector 333 detects the temperature and the relative humidity of the space inside the drum 61. The second temperature/humidity detector 333 may output the temperature and humidity detection values as analog signal or as digital data indicating the detected values. The detected temperature and detected humidity may also be output as a combined value.

The sheet manufacturing apparatus 100 also has a second thickness detector 334. The second thickness detector 334 is a sensor that detects the thickness of the second web W2. For example, the second thickness detector 334 may be an optical thickness sensor that has a light source and a photosensor, emits light to the second web W2, and detects the amount of light passing the second web W2 to detect the thickness of the second web W2. The second thickness detector 334 may also be a contact thickness sensor having a probe that contacts the second web W2, and an encoder that detects the position of the probe, and detects the distance between the surface of the second web W2 and the surface of the mesh belt 72. The second thickness detector 334 may also be an ultrasonic thickness sensor, or a sensor that detects thickness by another method.

The controller 110 may also control adjusting the thickness of the second web W2 based on the output of the second thickness detector 334. For example, if the thickness detected by the second thickness detector 334 is outside a predetermined range, the controller 110 may stop the sheet manufacturing apparatus 100 or issue a warning.

1-4. Controller Configuration

Figure 4:
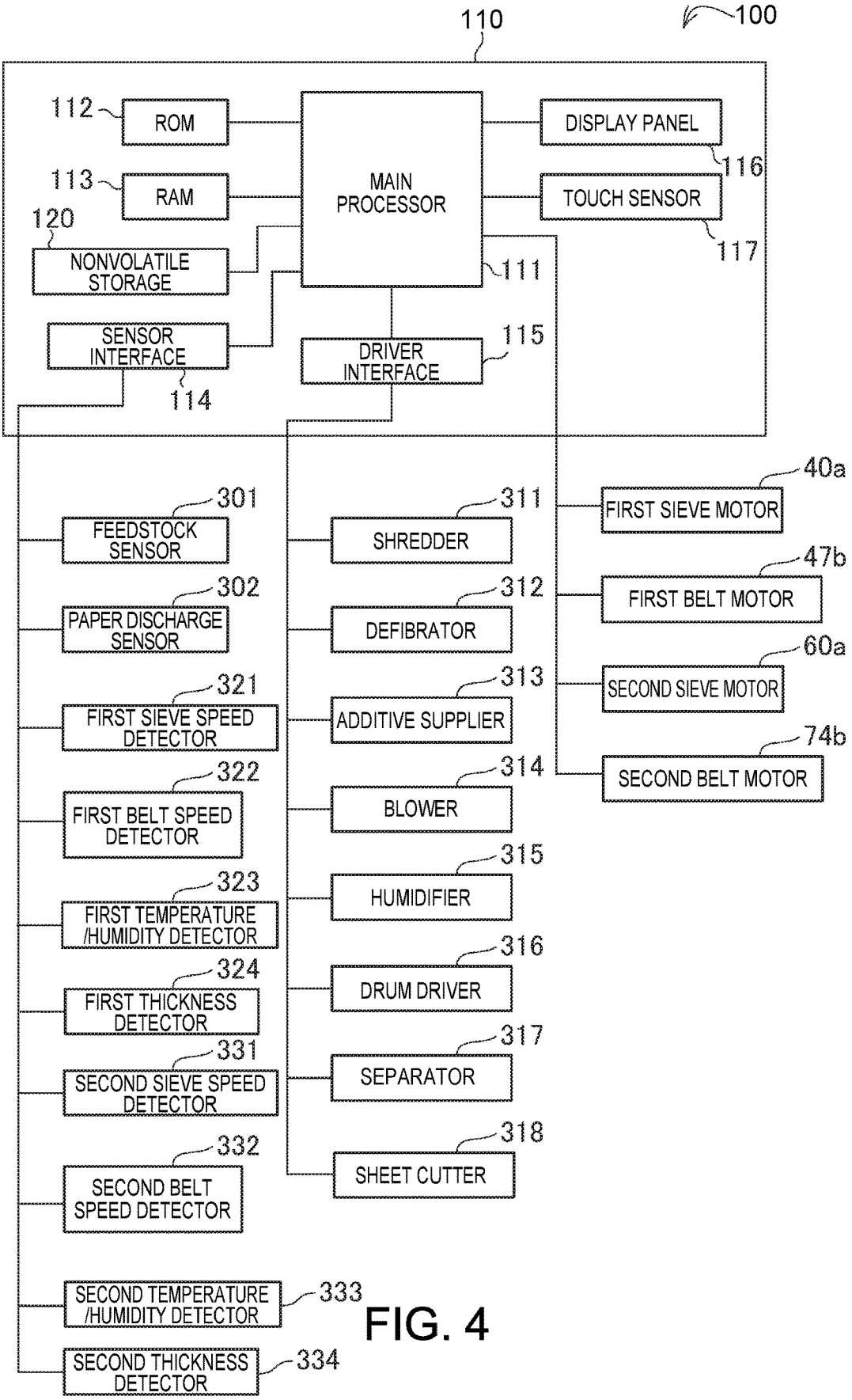
FIG. 4 is a block diagram of the control system of the sheet manufacturing apparatus.

FIG. 4 is a block diagram of the control system of the sheet manufacturing apparatus 100.

The sheet manufacturing apparatus 100 has a controller 110 that has a main processor 111 configured to control parts of the sheet manufacturing apparatus 100.

The controller 110 has a main processor 111, ROM (Read Only Memory) 112, and RAM (Random Access Memory) 113.

The main processor 111 is embodied by a processor such as a CPU (central processing unit), and controls parts of the sheet manufacturing apparatus 100 by running a basic control program stored in ROM 112. The main processor 111 may also be configured as a system chip including ROM 112, RAM 113, or other peripheral circuits, or other IP cores.

ROM 112 nonvolatilely stores programs executed by the main processor 111.

RAM 113 provides working memory used by the main processor 111, and temporarily stores programs the main processor 111 runs and data that is processed.

Nonvolatile storage 120 stores programs the main processor 111 executes, and data the main processor 111 processes.

The display panel 116 is an LCD or other type of display panel, and in this example is disposed externally to the sheet manufacturing apparatus 100. The display panel 116 displays the operating status of the sheet manufacturing apparatus 100, various settings, and warnings, for example.

The touch sensor 117 detects user operations by touch or pressure. In this example, the touch sensor 117 is disposed over the display surface of the display panel 116, and detects operations on the display panel 116. In response to operations, the touch sensor 117 outputs to the main processor 111 operating data including the operating position and the number of operating positions. Based on output from the touch sensor 117, the main processor 111 detects operation of the display panel 116, and acquires the operating positions. The main processor 111 enables GUI (graphical user interface) operations based on the operating position detected by the touch sensor 117, and the display data 122 that was displayed on the display panel 116 when the operation was detected.

The controller 110 is connected through a sensor interface 114 to sensors disposed to parts of the sheet manufacturing apparatus 100. The sensor interface 114 is an interface that acquires detection values output by the sensors, and inputs to the main processor 111. The sensor interface 114 may include an A/D converter that converts analog signals output by the sensors to digital data. The sensor interface 114 may also supply drive current to the sensors. The sensor interface 114 may also include circuits that acquire sensor output values according to the sampling frequency controlled by the main processor 111, and output to the main processor 111.

The sensor interface 114 is also connected to a feedstock sensor 301, and a paper discharge sensor 302, for example. Also connected to the sensor interface 114 are the first sieve speed detector 321, first belt speed detector 322, first temperature/humidity detector 323, and first thickness detector 324. Additionally, the second sieve speed detector 331, second belt speed detector 332, second temperature/humidity detector 333, and second thickness detector 334 are connected to the sensor interface 114.

The first sieve speed detector 321 detects speed VB. The first sieve speed detector 321 may be configured with a rotary encoder and a sensor that contacts the rotary shaft or surface of the drum 41, and detects the rotational speed. The first sieve speed detector 321 may also be a circuit disposed inside the first sieve motor 40*a*, or configured as part of the first sieve motor 40*a*, that outputs a signal indicating the number of revolutions or the rotational speed of the first sieve motor 40*a*. The controller 110 may also function as the first sieve speed detector 321, and calculate the rotational speed of the first sieve motor 40*a* based on the drive current of the first sieve motor 40*a*.

The second sieve speed detector 331 detects speed VD, which is the operating speed of the drum 61. The second sieve speed detector 331 may be configured identically to the first sieve speed detector 321.

The first belt speed detector 322 detects speed VA, which is the operating speed of the mesh belt 46. The first belt speed detector 322 detects the speed of mesh belt 46 movement, the rotational speed of the tension rollers 74, or the rotational speed of the first belt motor 47*b*. The first belt speed detector 322 may be configured with a speed sensor or rotary encoder. The first belt speed detector 322 may also be a circuit disposed inside the first belt motor 47*b*, or configured as part of the first belt motor 47*b*, that outputs a signal indicating the number of revolutions or the rotational speed of the first belt motor 47*b*. The controller 110 may also function as the first belt speed detector 322, and calculate the rotational speed of the first belt motor 47*b* based on the drive current of the first belt motor 47*b*.

The second belt speed detector 332 detects speed VC, which is the operating speed of the mesh belt 72. The second belt speed detector 332 may be configured identically to the second sieve speed detector 331.

The feedstock sensor 301 detects the remaining amount of feedstock MA in the feedstock feeder 10. The paper discharge sensor 302 detects how many sheets S are stored in the tray or stacker of the tray 96.

The controller 110 is connected to the drivers of the sheet manufacturing apparatus 100 through a driver interface 115. The drivers of the sheet manufacturing apparatus 100 include motors, pumps, and heaters, for example. The driver interface 115 may be a configuration directly connected to a motor, or connected to a drive circuit or drive chip (IC chip) that supplies drive current to a motor.

A shredder 311, defibrator 312, additive supplier 313, blower 314, humidifier 315, drum driver 316, separator 317, and sheet cutter 318 are connected to the driver interface 115 as control objects of the controller 110.

The shredder 311 in this example includes a motor or other drive device for turning the shredder blades 14.

The defibrator 312 includes a motor or other drive device for turning the rotor (not shown in the figure) of the defibrator 20.

The additive supplier 313 includes drivers such as a motor that drives a screw feeder for out-feeding additive, and a motor or actuator that opens and closes the shutters.

The blowers 314 include the first collection blower 28, mixing blower 56, and second collection blower 68. These blowers may individually connect to the driver interface 115.

The humidifier 315 includes the ultrasonic vibration generator (not shown in the figure) of the wetting device 78, a fan (not shown in the figure), and a pump (not shown in the figure).

The drum driver 316 includes drivers such as a motor for turning drum 41, and a motor for turning drum 61.

The separator 317 includes a driver such as a motor (not shown in the figure) for turning the rotor 49.

The sheet cutter 318 includes motors (not shown in the figure) for respectively operating the blades of the first cutter 92 and second cutter 94 of the sheet cutter 90.

A motor for driving the calender rolls 85, and a heater for heating the heat rollers 86, may also be connected to the driver interface 115.

A first sieve motor 40*a*, first belt motor 47*b*, second sieve motor 60*a*, and second belt motor 74*b* are also connected to the driver interface 115. The controller 110 can control these motors to start turning and stop turning. The controller 110 can also control the speed of the first sieve motor 40*a* and first belt motor 47*b*.

Figure 5:
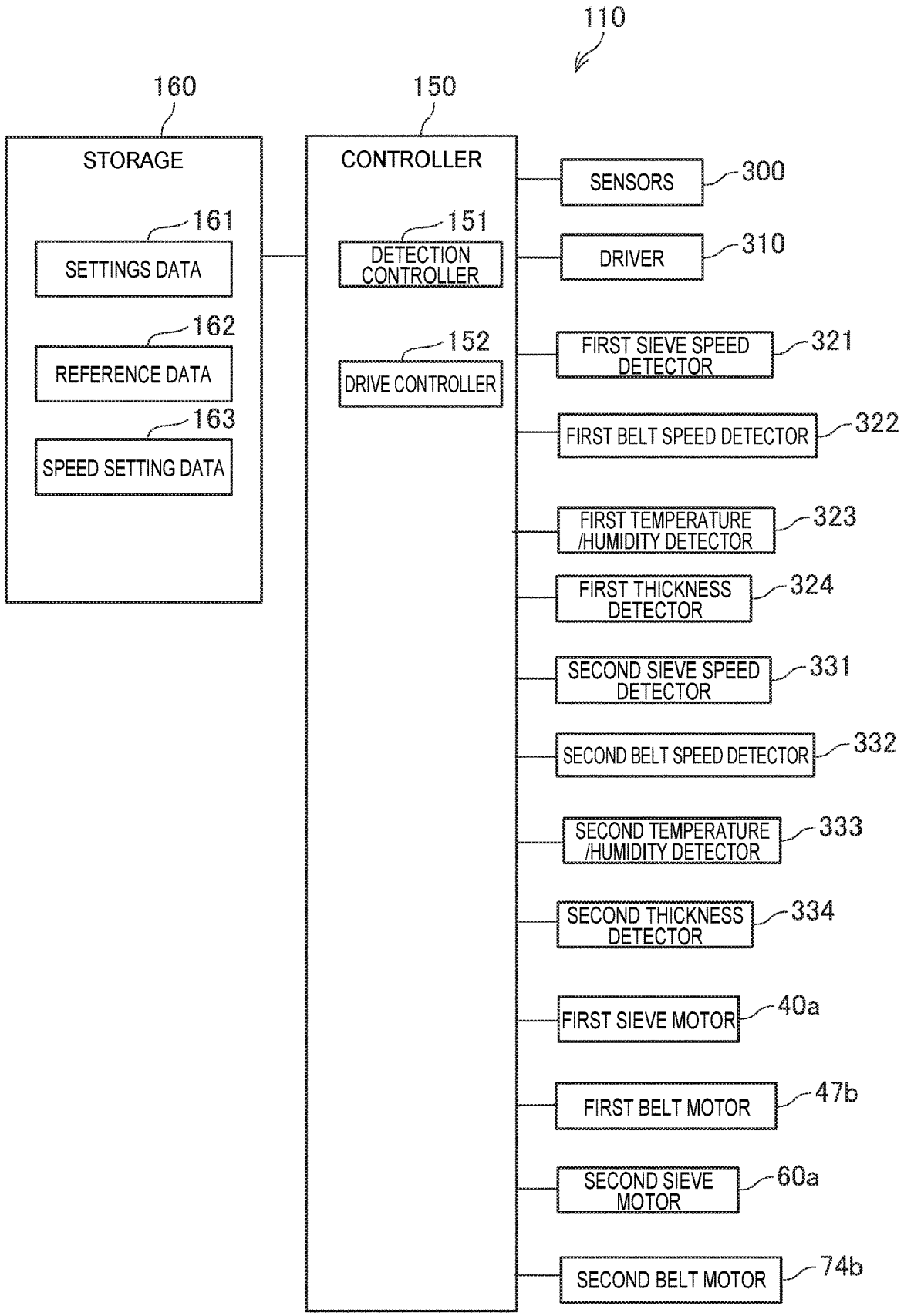
FIG. 5 is a function block diagram of the controller.

FIG. 5 is a function block diagram of the controller 110.

The controller 110 embodies various function units by the cooperation of hardware and software resulting from a main processor 111 running a program. FIG. 5 shows the functions of the main processor 111 embodying these function units as controller 150. The controller 110 also configures storage 160, which is a logical storage device, using the memory area of the nonvolatile storage 120. The storage 160 may be configured using memory areas in ROM 112 and RAM 113.

The controller 150 has a detection controller 151 and a drive controller 152. These controllers are embodied by the main processor 111 running a program. The controller 110 may also execute an operating system (OS) as a basic control program for controlling the sheet manufacturing apparatus 100 and configuring a platform for running application programs. In this case, the function units of the controller 150 may be embodied as application programs.

In FIG. 5, detectors controlled by the controller 150 include the first sieve speed detector 321, first belt speed detector 322, first temperature/humidity detector 323, and first thickness detector 324. A second sieve speed detector 331, second belt speed detector 332, second temperature/humidity detector 333, and second thickness detector 334 are also shown. These sensors are collectively referred to as sensors 300.

FIG. 5 also shows the first sieve motor 40*a*, first belt motor 47*b*, second sieve motor 60*a*, and second belt motor 74*b* as drivers controlled by the controller 150. These other drivers are collectively referred to as driver 310.

The storage 160 stores data processed by the controller 150. In this example, the storage 160 more specifically stores settings data 161, reference data 162, and speed setting data 163.

The settings data 161 is generated by operating the touch sensor 117, or based on commands and data input through a communication interface (not shown in the figure) of the controller 110, and stored in storage 160.

The settings data 161 include various settings related to operation of the sheet manufacturing apparatus 100. For example, the settings data 161 may include the number of sheets S manufactured by the sheet manufacturing apparatus 100, the type and color of sheets S, operating conditions for parts of the sheet manufacturing apparatus 100, and other settings. The settings data 161 also includes a setting input through the touch sensor 117 related to the length of fiber in the feedstock material MA the sheet manufacturing apparatus 100 processes. For example, when the feedstock material MA is sheets S that were manufactured by the sheet manufacturing apparatus 100 and contain fiber that has been processed multiple times by the sheet manufacturing apparatus 100, and when the feedstock material MA contains fiber sourced from deciduous trees, the feedstock material MA contains short fibers. The settings data 161 may include values for input items related to the length of fiber in the feedstock material MA, such as the type of feedstock material MA, as data related to the length of fiber in the feedstock material MA.

The reference data 162 includes reference values for evaluating the operating conditions for making sheets S in the sheet manufacturing apparatus 100. More specifically, the reference data 162 includes a reference value for determining whether the humidity detected by the first temperature/humidity detector 323 is high or low.

The reference data 162 may also include reference values for evaluations related to the speed detected by the first sieve speed detector 321, first belt speed detector 322, second sieve speed detector 331, and second belt speed detector 332.

The reference data 162 may also include standards for evaluating the detection values output from the first thickness detector 324 and second thickness detector 334.

The reference values included in the reference data 162 may be a single value, or range values including maximum and minimum values for a range.

The speed setting data 163 includes data for the controller 150 to control the speed of the first belt motor 47*b*. When the sheet manufacturing apparatus 100 starts, the controller 150 causes the first sieve motor 40*a* and first belt motor 47*b* to accelerate, and operates the drum 41 and mesh belt 46 at a speed suitable for making a sheet S. The sheet manufacturing apparatus 100 starting means the sheet manufacturing apparatus 100 starting the operation for making a sheet S from a stop. To suppress variation in the thickness of the first web W1 in this process, the controller 150 increases speed VA from speed 0.

The speed setting data 163 includes data related to speed when accelerating the mesh belt 46 from a stopped state to speed VA. For example, the speed setting data 163 includes data related to speed conditions defining the correlation between time and speed VA when accelerating the mesh belt 46 from speed 0. The speed conditions may be conditions defining the change in speed, which may be referred to as the speed pattern.

The detection controller 151 controls detected by the sensors 300, and acquires the detection values from the sensors. The detection controller 151 also acquires the detection values from the first sieve speed detector 321, first belt speed detector 322, first temperature/humidity detector 323, and first thickness detector 324. The detection controller 151 also acquires the detection values from the second sieve speed detector 331, second belt speed detector 332, second temperature/humidity detector 333, and second thickness detector 334.

By controlling the driver 310 based on the detection values of the sensors 300 acquired by the detection controller 151, the drive controller 152 operates parts of the sheet manufacturing apparatus 100 according to the values in the settings data 161, and manufactures a sheet S.

The drive controller 152 drives the first sieve motor 40*a*, first belt motor 47*b*, second sieve motor 60*a*, and second belt motor 74*b*. Based on the detection values of the first sieve speed detector 321 and first belt speed detector 322 acquired by the detection controller 151, the drive controller 152 controls the speed of the first sieve motor 40*a* and first belt motor 47*b*. As a result, speed VA and speed VB are adjusted to the set speeds.

Based on the detection values of the second sieve speed detector 331 and second belt speed detector 332 acquired by the detection controller 151, the drive controller 152 controls the speed of the second sieve motor 60*a* and second belt motor 74*b*. As a result, speed VC and speed VD are adjusted to the set speeds.

The drive controller 152 sets the speed conditions of the first belt motor 47*b* when starting the drum 41 and mesh belt 46 from a stop. The speed conditions are data defining the rate of acceleration when accelerating the first belt motor 47*b* from a full stop. The drive controller 152 sets the speed conditions based on the detection values of the first temperature/humidity detector 323 acquired by the detection controller 151, the settings data 161, reference data 162, and speed setting data 163.

1-5. Sheet Manufacturing Apparatus Operation

Figure 6:
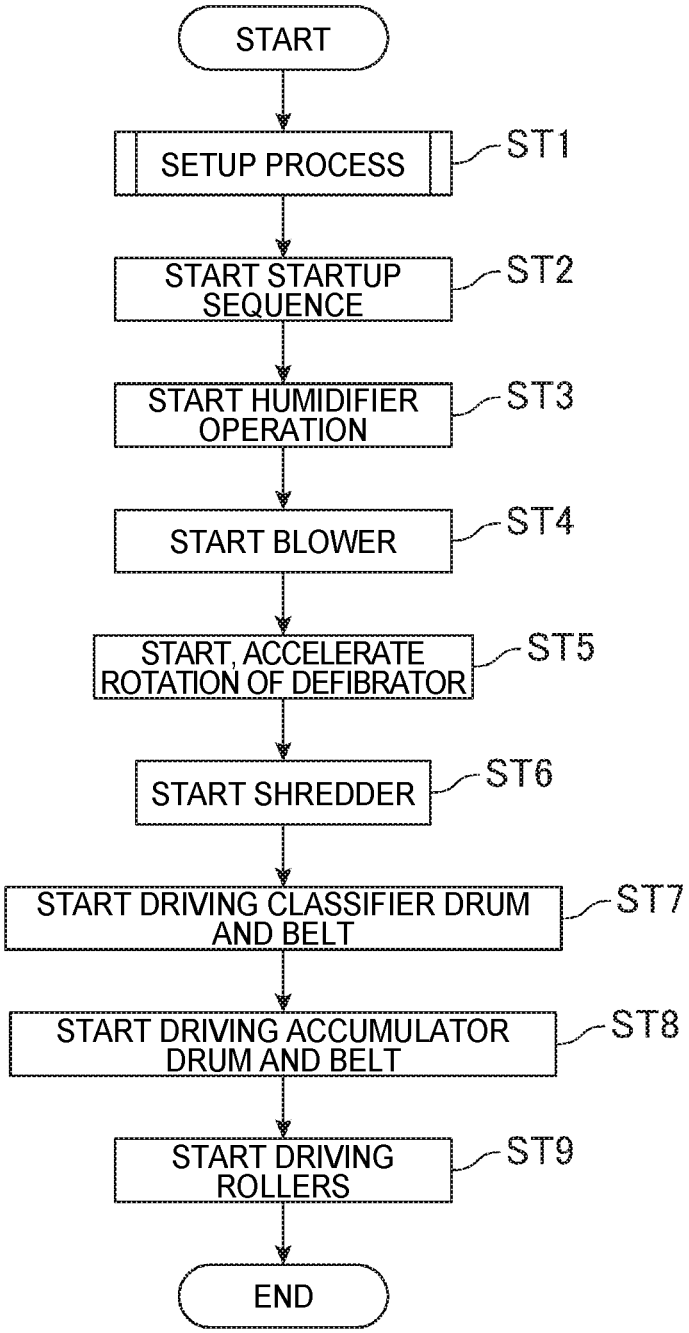
FIG. 6 is a flow chart of sheet manufacturing apparatus operation.
Figure 7:
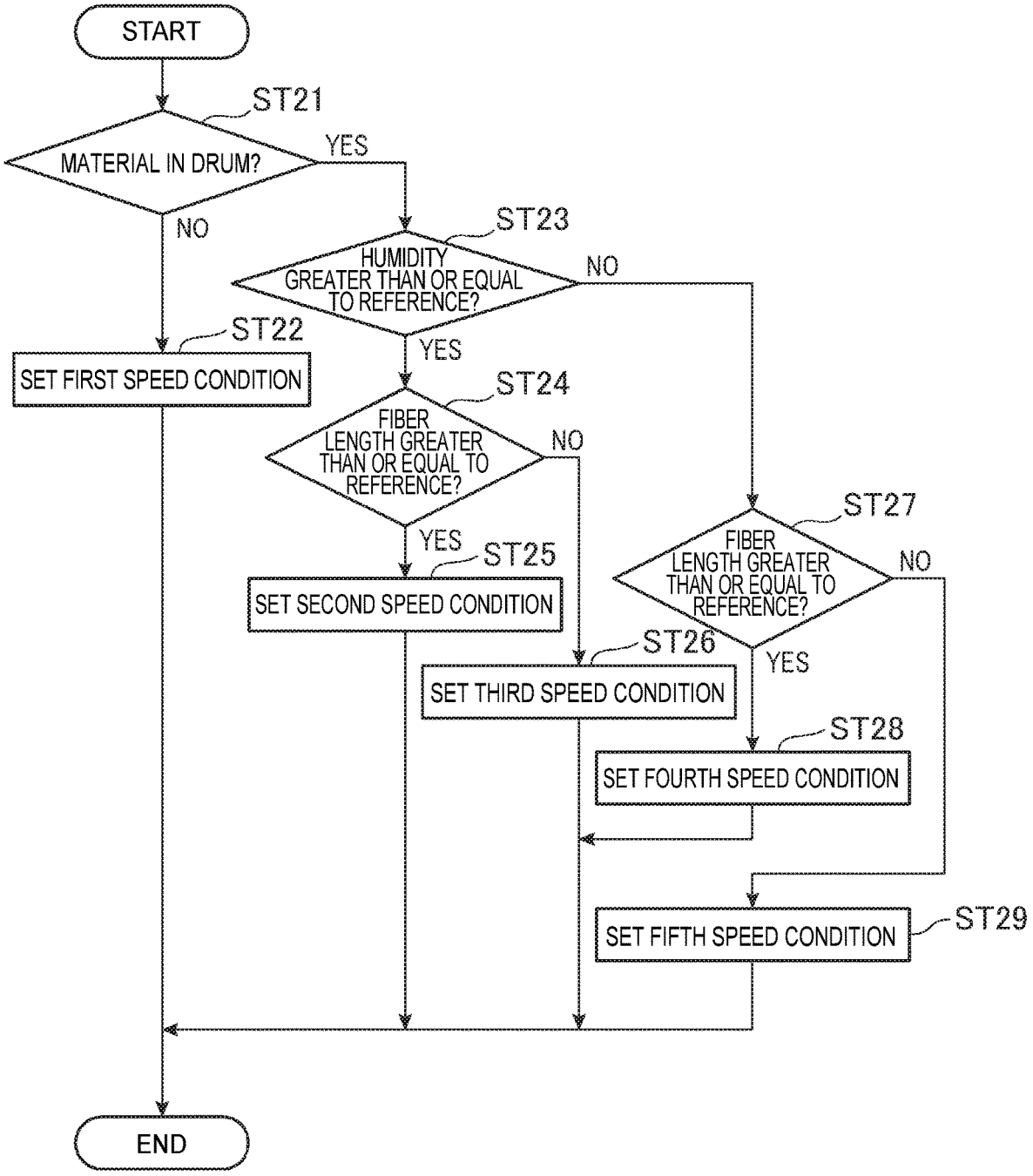
FIG. 7 is a flow chart of sheet manufacturing apparatus operation.

FIG. 6 and FIG. 7 are flow charts of the operation of the sheet manufacturing apparatus 100, and describe the operation of starting the sheet manufacturing apparatus 100 from when the sheet manufacturing apparatus 100 is stopped. The operation shown in FIG. 6 and FIG. 7 is executed by the drive controller 152 of the controller 150.

The controller 150 first executes a setup process related to first belt motor 47*b* operation (step ST1). The setup process of step ST1 is a process of making settings related to the speed of the first belt motor 47*b* when the first sieve motor 40*a* starts operating. This setup process is described below with reference to FIG. 7.

After the setup process, the controller 150 starts the startup sequence (step ST2). The startup sequence is a sequence of operations sequentially starting parts of the sheet manufacturing apparatus 100 from the stopped state of the sheet manufacturing apparatus 100. More specifically, the startup sequence starts the shredder 12, defibrator 20, classifier 40, first web former 45, rotor 49, mixing device 50, air-laying device 60, second web former 70, sheet former 80, and sheet cutter 90 from the stopped state.

When the startup sequence starts, the controller 150 controls the humidifier 315 to start operation of the wetting device 78 (step ST3). If the sheet manufacturing apparatus 100 has devices other than the wetting device 78 that add humidity, the controller 150 also starts those devices in step ST3.

Next, the controller 150 starts the blower 314 (step ST4), and starts the defibrator 312 and thereby starts the defibrator 20 turning (step ST5). The defibrator 20 then accelerates to a previously set speed, and thereafter operates at a constant speed.

Next, the controller 150 starts the shredder 311 (step ST6). After step ST6, feedstock containing fiber is supplied to the shredder 311.

The controller 150 also starts the first sieve motor 40*a* and first belt motor 47*b*, and starts driving the drum 41 and mesh belt 46 of the classifier 40 (step ST7). In step ST7, the first belt motor 47*b* is started and the speed of the first belt motor 47*b* increases according to the conditions set in step ST1. Also in step ST7, the controller 150 starts the first sieve motor 40*a*, and accelerates the first sieve motor 40*a* according to a previously set target speed and rate of acceleration.

Next, the controller 150 starts the second sieve motor 60*a* and second belt motor 74*b*, and starts the drum 61 and mesh belt 72 (step ST8). The controller 150 then starts operation of the calender rolls 85 and heat rollers 86 of the sheet former 80 (step ST9), and completes the startup sequence.

FIG. 7 is a flow chart of the setup process executes in step ST1 in FIG. 6.

The controller 150 first determines if there is defibrated material MB inside the drum 41 (step ST21). Whether or not there is any defibrated material MB may be determined based on input from the touch sensor 117, for example.

If there is no defibrated material MB inside the drum 41 (step ST21: NO), the controller 150 sets a first speed condition as the condition for accelerating the speed of the first belt motor 47*b* (step ST22), and ends the setup process.

If there is defibrated material MB inside the drum 41 (step ST21: YES), the controller 150 determines whether or not the humidity detected by the first temperature/humidity detector 323 is greater than or equal to the reference value contained in the reference data 162 (step ST23). If the humidity is greater than or equal to the reference value (step ST23: YES), the controller 150 determines if the length of fiber contained in the defibrated material MB is greater than or equal to the reference value contained in the reference data 162 (step ST24).

If the length of fiber contained in the defibrated material MB is greater than or equal to the reference value contained in the reference data 162 (step ST24: YES), the controller 150 sets a second speed condition as the condition for accelerating the speed of the first belt motor 47*b* (step ST25), and ends the setup process.

If the length of fiber contained in the defibrated material MB is shorter than the reference value (step ST24: NO), the controller 150 sets a third speed condition as the condition for accelerating the speed of the first belt motor 47*b* (step ST26), and ends the setup process.

However, if the humidity is less than the reference value (step ST23: NO), the controller 150 determines if the length of fiber contained in the defibrated material MB is greater than or equal to the reference value contained in the reference data 162 (step ST27).

If the length of fiber contained in the defibrated material MB is greater than or equal to the reference value (step ST27: YES), the controller 150 sets a fourth speed condition as the condition for accelerating the speed of the first belt motor 47*b* (step ST28), and ends the setup process.

If the length of fiber contained in the defibrated material MB is shorter than the reference value (step ST27: NO), the controller 150 sets a fifth speed condition as the condition for accelerating the speed of the first belt motor 47*b* (step ST28), and ends the setup process.

The first to fifth speed conditions are basic conditions for accelerating from zero to speed VB when starting the drum 41, and include a target speed for the first belt motor 47*b*, and either the time for acceleration to the target speed or the acceleration rate of the first belt motor 47*b*.

Figure 8:
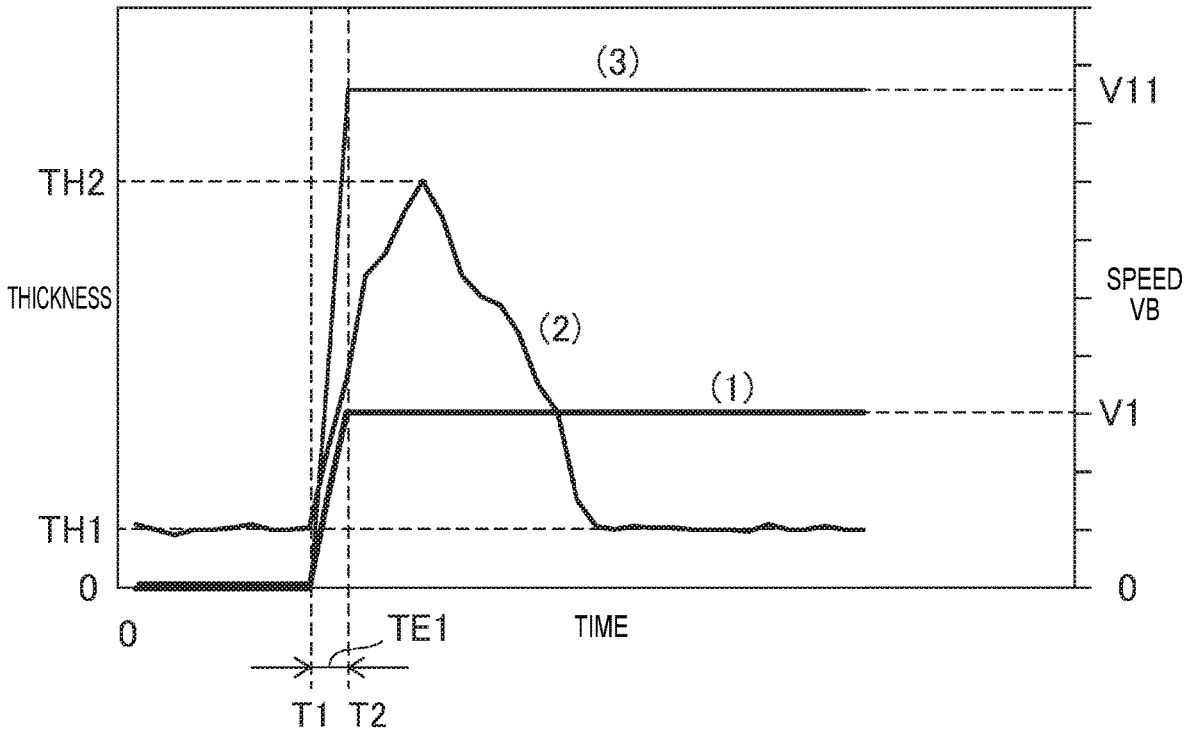
FIG. 8 is a graph showing an example of the relationship between the operating speed of the mesh belt and change in the thickness of the first web.

FIG. 8 is a graph showing an example of the operating speed VA of the mesh belt 46 and change in thickness of the first web W1. FIG. 8 (1) indicates the speed VA detected by the first belt speed detector 322, (2) indicates the detection value of the first web W1 detected by the first thickness detector 324, and (3) indicates the speed VB of the drum 41 detected by the first sieve speed detector 321.

The Y-axes indicate speeds VA and VB, and the thickness of the first web W1, and coordinate 0 on the Y-axis indicates speed 0 (stopped) and the first web W1 thickness 0. The X-axis indicates time, and coordinate 0 indicates the beginning of the startup sequence. After the startup sequence starts, the time at which the first sieve motor 40*a* and first belt motor 47*b* start operating is time T1.

The target value set for the thickness of the first web W1 is thickness TH1. In this operating example, the thickness of the first web W1 is ideally held constant at thickness TH1. The thickness TH1 is set to a value in the range 2 mm to 10 mm in this example, but may be set thicker or thinner.

FIG. 8 is an example of a the controller 150 controlling the first sieve motor 40*a* and first belt motor 47*b* according to the first speed condition.

In the examples shown in FIG. 8 and FIG. 9 to FIG. 11 described below, the target speed for speed VA is set to speed V1. This target speed V1 is the speed VA when the sheet manufacturing apparatus 100 makes sheets S, and is an example of a first speed in the invention. The target speed V1 may be set to a value in the range 50 mm/s-1000 mm/s, for example, but may be slower or faster. The speed VB of the drum 41 is set to a value in the range 50 rpm-1000 rpm for example.

As shown in FIG. 8, after starting the first sieve motor 40*a* at time T1, the controller 150 accelerates the first sieve motor 40*a* until speed VB reaches target speed V11, and thereafter holds speed VB at speed V11. This speed V11 is the speed VB when the sheet manufacturing apparatus 100 manufactures sheets S, and is an example of a third speed in the invention.

Note that in this example the time from when the mesh belt 46 starts until speed VA reaches speed V11 is referred to as the speed adjustment period.

The first speed condition is the condition enabling speed VA to reach target speed V1 by time T2. In other words, the speed adjustment period is period TE1 from time T1 to time T2. Period TE1 is set in this example to a range from 1 second to 10 seconds, but may be shorter or longer.

In the first speed condition, the speed adjustment period is equal to the time required to accelerate the first belt motor 47*b*. The controller 150 drives the drive roller 47*a* to accelerate at a default acceleration rate after starting the first belt motor 47*b*, and stops acceleration when speed VA reaches target speed V1. The time required for this acceleration is the speed adjustment period.

As described above, when the drum 41 starts operating with defibrated material MB inside the drum 41, the amount of first screened material MC falling from the drum 41 is temporarily greater than when defibrated material MB is not in the drum 41. As a result, the amount of first screened material MC dropping to the mesh belt 46 after the first sieve motor 40*a* starts turning is temporarily greater than the amount suitable for making a sheet S. As a result, as indicated by the (2) in FIG. 8, the thickness of the first web W1 exceeds thickness TH1, and the peak thickness TH2 is significantly greater than thickness TH1.

In the setup process shown in FIG. 7, the controller 150 sets one of the second to fifth speed conditions when defibrated material MB is already inside the drum 41.

The second to fifth speed conditions each set the speed adjustment period longer than period TE1, and provide a period during the speed adjustment period in which speed VA reaches a speed greater than target speed V1. By reaching a speed VA greater than the target speed V1, the speed of the mesh belt 46 moving below the drum 41 increases, and the amount of first screened material MC per unit area of the mesh belt 46 decreases. As a result, the thickness of the first web W1 accumulating on the mesh belt 46 decreases. Increasing the thickness of the first web W1 can be suppressed by setting speed VA to a higher speed while the amount of first screened material MC falling from the drum 41 is high. The speed adjustment period in this case is the time until the speed VA reaches the target speed V1, and the speed VA during the speed adjustment period is greater than the target speed V1, but speed VA may be less than target speed V1 temporarily.

In the second speed condition, defibrated material MB is in the drum 41, the humidity detected by the first temperature/humidity detector 323 is greater than or equal to the reference value, and the fiber length is greater than or equal to the reference value. The second speed condition is a condition whereby the speed adjustment period is adjusted to a period longer than period TE1. In the second speed condition, speed VA is greater than target speed V1 for at least part of the speed adjustment period. The second speed condition includes information specifying the maximum setting for the speed VA, and may include information specifying the length of the speed adjustment period. The second speed condition may also include information specifying the pattern of change in the speed VA during the speed adjustment period, thereby enabling changing speed VA during the speed adjustment period.

In the fourth speed condition, defibrated material MB is in the drum 41, the humidity detected by the first temperature/humidity detector 323 is lower than to the reference value, and the fiber length is greater than or equal to the reference value. Because the humidity inside the drum 41 is lower than when the second speed condition is set, the amount of first screened material MC falling from the drum 41 increases temporarily. As a result, the fourth speed condition is a condition whereby the thickness of the first web W1 accumulated on the mesh belt 46 becomes thinner than under the second speed condition. The fourth speed condition is an example of a condition setting the length of the speed adjustment period longer than in the second speed condition, and/or a condition in which the maximum speed VA is higher than in the second speed condition.

In the third speed condition, defibrated material MB is in the drum 41, the humidity detected by the first temperature/humidity detector 323 is greater than or equal to the reference value, and the fiber length is shorter than the reference value. Because the fiber length is shorter than when the second speed condition is set, the amount of first screened material MC falling from the drum 41 increases temporarily. As a result, the third speed condition is a condition whereby the thickness of the first web W1 accumulated on the mesh belt 46 becomes thinner than under the second speed condition. The third speed condition is an example of a condition setting the length of the speed adjustment period longer than in the second speed condition, and/or a condition in which the maximum speed VA is higher than in the second speed condition.

Note that the length of the speed adjustment period and/or the maximum speed VA may be the same or different in the third speed condition and the fourth speed condition.

The length of the speed adjustment period and the maximum speed VA may be determined with consideration for whether the effect of humidity inside the drum 41 on the amount of first screened material MC that drops from the drum 41, or the effect of the length of fiber in the defibrated material MB on the amount of first screened material MC that drops from the drum 41, is greater.

When the effect of humidity inside the drum 41 on the amount of first screened material MC that drops through is greater than the effect of the length of fiber in the defibrated material MB, the fourth speed condition is preferably configured so that the thickness of the first web W1 is thinner than in the third speed condition. More specifically, the fourth speed condition is preferably configured so that the length of the speed adjustment period is greater than in the third speed condition, or the maximum speed VA is greater in the fourth speed condition than in the third speed condition, or both of these conditions are met.

However, if the effect of humidity inside the drum 41 on the amount of first screened material MC that drops through is less than the effect of the length of fiber in the defibrated material MB, the third speed condition is preferably configured so that the thickness of the first web W1 is thinner than in the fourth speed condition. More specifically, the third speed condition is preferably configured so that the length of the speed adjustment period is greater than in the fourth speed condition, or the maximum speed VA is greater in the third speed condition than in the fourth speed condition, or both of these conditions are met.

The fifth speed condition is set when there is defibrated material MB inside the drum 41, the humidity detected by the first temperature/humidity detector 323 is lower than the reference value, and the length of fiber is shorter than the reference value. Compared with the first to fourth speed conditions, the thickness of the first web W1 is thinner when the fifth speed condition is set. More specifically, compared with the first to fourth speed conditions, the length of the speed adjustment period is longer, and/or the maximum speed VA is higher, in the fifth speed condition.

As described above, when the amount of first screened material MC dropping from the drum 41 to the mesh belt 46 may increase temporarily, the controller 150 sets the speed VA during the speed adjustment period greater than target speed V1 when the first belt motor 47*b* starts operating. As a result, the controller 150 suppresses variation in the thickness of the first web W1, and in the process of the sheet manufacturing apparatus 100 making sheets S, the amount of first screened material MC supplied to processes downstream from the first web former 45 can be stabilized. Because variation in the quality of the sheets S can therefore be suppressed, the burden of making manual adjustments to suppress variation in the quality of the sheets S can also be reduced.

Figure 9:
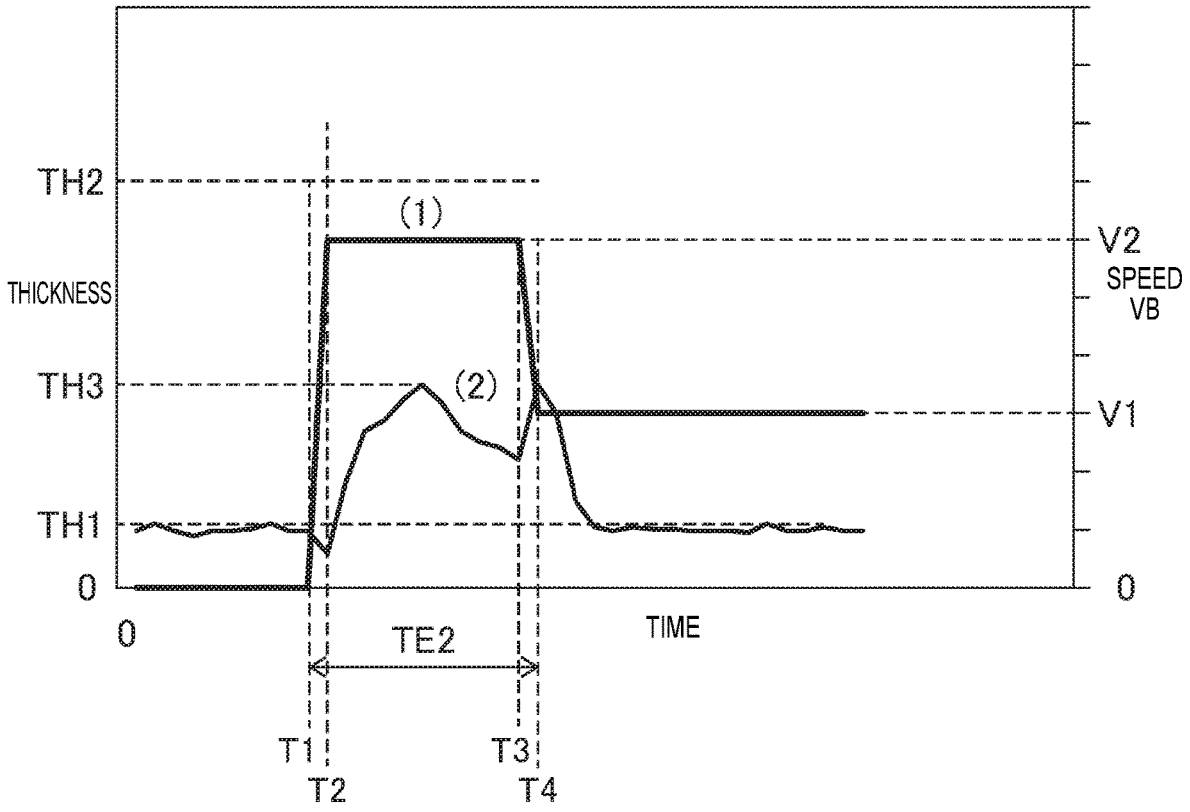
FIG. 9 is a graph showing an example of the relationship between the operating speed of the mesh belt and change in the thickness of the first web.
Figure 10:
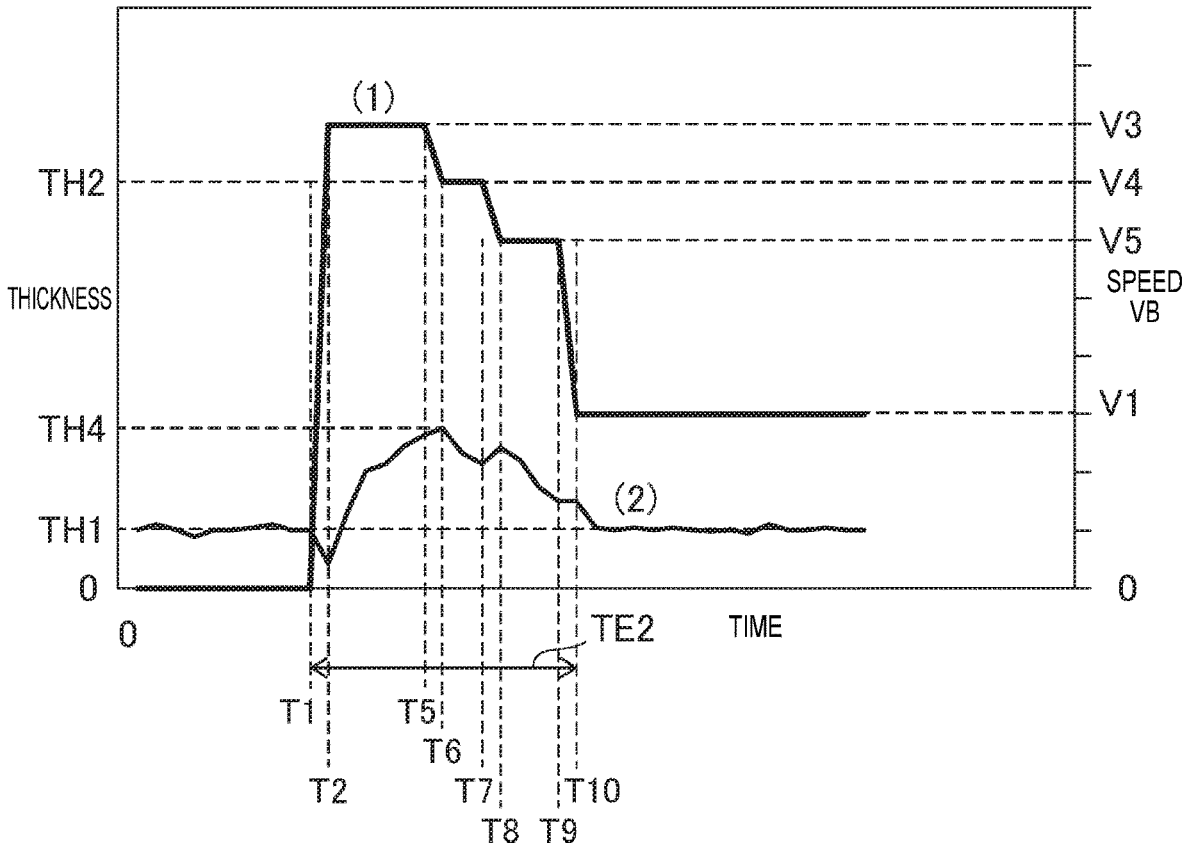
FIG. 10 is a graph showing an example of the relationship between the operating speed of the mesh belt and change in the thickness of the first web.
Figure 11:
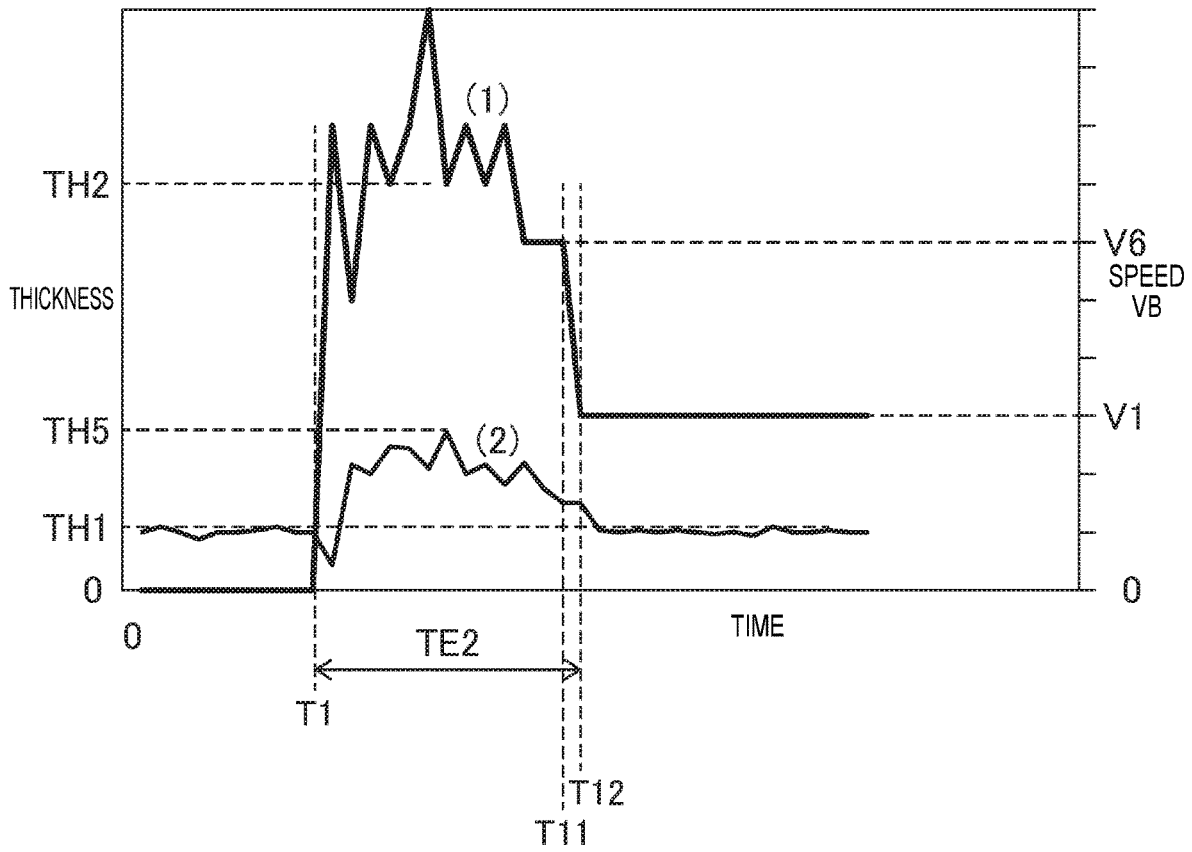
FIG. 11 is a graph showing an example of the relationship between the operating speed of the mesh belt and change in the thickness of the first web.

FIG. 9, FIG. 10, and FIG. 11 are graphs showing examples of the operating speed VA of the mesh belt 46 and change in the thickness of the first web W1 when the second to fifth speed conditions are set.

In these figures, (1) indicates speed VA detected by the first belt speed detector 322, and (2) indicates the thickness of the first web W1 detected by the first thickness detector 324. The Y-axis, X-axis, target speed V1, thickness TH1 and TH2, and time T1 are the same as in FIG. 8. For comparison, these figures also show time T2 from FIG. 8.

FIG. 9 shows an example in which the speed VA changes in steps, and more specifically an example in which speed VA changes in two steps. The controller 150 sets a period for holding an intermediate speed V2 that is lower than the target speed V1 before starting accelerating speed VA to target speed V1. More specifically, the controller 150 starts turning the first belt motor 47*b* at time T1, and accelerates the first belt motor 47*b* so that speed VA reaches intermediate speed V2 at time T2. The controller 150 then holds speed VA at intermediate speed V2 until time T3, then decelerates the first belt motor 47*b* from time T3 to time T4 to reach target speed V1 at time T4.

The speed adjustment period is indicated by reference numeral TE2 in the example in FIG. 9. This speed adjustment period TE2 is an example of a first period. The speed adjustment period TE2 (time T1-T4) is longer than the period from time T1-T2. In addition, speed VA in the speed adjustment period TE2 is greater than target speed V1. As a result, the controller 150 holds speed VA at a speed greater than target speed V1 during the speed adjustment period TE2 after the first belt motor 47*b* starts turning. As shown in FIG. 9 (2), the detection value of the first thickness detector 324 varies from around time T2, but the peak thickness TH3 of the first web W1 is less than the peak thickness TH2 shown in FIG. 8. It is thus obvious that variation in the thickness of the first web W1 is suppressed.

FIG. 10 shows an example in which the speed VB changes in steps, and more specifically an example in which speed VB changes in multiple steps. The controller 150 sets multiple periods for holding speed VA at intermediate speeds V3, V4 and V5 that are lower than the target speed V1 during the speed adjustment period TE2 (time T1 to T10). More specifically, the controller 150 starts turning the first belt motor 47*b* at time T1, and accelerates the first belt motor 47*b* so that speed VA reaches intermediate speed V3 at time T2. The controller 150 then holds speed VA at intermediate speed V3 from time T2 to time T5, and at time T5 slows the first belt motor 47*b* so that speed VA reaches intermediate speed V4 at time T6. The controller 150 then holds speed VA at intermediate speed V4 from time T6 to time T7, and at time T7 slows the first belt motor 47*b* so that speed VA reaches intermediate speed V5 at time T8. The controller 150 then holds speed VA at intermediate speed V3 from time T8 to time T9, and at time T9 slows the first belt motor 47*b* so that speed VA reaches intermediate speed V1 at time T10.

In the example in FIG. 10, the speed adjustment period TE2 is from time T1 to time T10. This speed adjustment period TE2 is longer than the period from time T1 to time T2 in FIG. 8. The controller 150 thus holds the speed VA above the target speed V1 during the speed adjustment period TE2 after the first belt motor 47*b* starts turning.

As shown by curve (2) in FIG. 10, the value detected by the first thickness detector 324 fluctuates from approximately time T11, but the peak thickness TH4 of the first web W1 is less than the peak thickness TH2 shown in FIG. 8. More specifically, the peak thickness TH4 is successfully suppressed by inserting a speed adjustment period TE2 in which the speed is greater than the target speed V1 immediately after the drum 41 starts turning when the amount of first screened material MC passing through the drum 41 increases easily.

As shown in FIG. 9 and FIG. 10, the controller 150 can change the speed VA in steps, and the number of steps of change in the speed VA, and the intermediate speeds, can be varied. For example, speed VA may be changed in five or more steps.

The controller 150 may also be configured to not maintain the speed VA at a constant rate during the speed adjustment period TE2. In this case, the controller 150 may control a linear change in the speed VA. More specifically, the first belt motor 47*b* may be operated so that the rate of change in the speed VA maintains a constant rate of acceleration. The controller 150 may also control the first belt motor 47*b* so that the acceleration rate of speed VA changes during the speed adjustment period TE2. Each of these configurations can be expected to suppress variation in the first web W1 insofar as the period TE1 is longer than from time T1 to time T2, and speed VA is greater than the target speed V1 during the speed adjustment period TE2.

FIG. 11 shows an example of the controller 150 controlling the speed of the first belt motor 47*b* based on the detection value received from the first thickness detector 324, that is, an example of feedback control. In this example, the length of the speed adjustment period TE2 is set as an operating condition of the first belt motor 47*b*. The operating conditions of the first belt motor 47*b* may also include the minimum speed VA during the speed adjustment period TE2.

In the example in FIG. 11, the controller 150 starts accelerating the first belt motor 47*b*, and starts acquiring the detection value from the first thickness detector 324, at time T1. The controller 150 increases or decreases the speed of the first belt motor 47*b* according to the difference between the detection value from the first thickness detector 324 and a threshold value. The threshold value related to the detection value of the first thickness detector 324 may be thickness TH1, or another value included in the reference data 162.

In the example in FIG. 11, speed VA is greater than target speed V1 for at least part of the speed adjustment period TE2. The controller 150 decelerates the first belt motor 47*b* from time T11 so that the speed VA goes to target speed V1 at time T12 according to the length of the speed adjustment period TE2 defined by the speed conditions.

In the example in FIG. 11, the second to fifth speed conditions may contain little information, such as information indicating the length of the speed adjustment period TE2, which has the advantage of simplifying the process setting the second to fifth speed conditions.

The second to fifth speed conditions can use the examples shown in FIG. 9 to FIG. 11. For example, all of the second to fifth speed conditions can use the two step acceleration pattern shown in FIG. 9. In this case, the second to fifth speed conditions may include information indicating the length of the speed adjustment period TE2, or information indicating the maximum and/or minimum speed VA in the speed adjustment period TE2. In addition, the second to fifth speed conditions may include patterns that change the speed VA as shown in FIG. 9.

The pattern of change in speed VA may also be the same in the second to fifth speed conditions. For example, the second to fifth speed conditions may be conditions that change speed VA by the different patterns shown in FIG. 9 to FIG. 11.

Furthermore, in the examples in FIG. 9 to FIG. 10, speed VA is held constant after reaching target speed V1, but speed VA does not need to remain constant at target speed V1 throughout sheet S production. For example, speed VA may be varied according to the sheet S manufacturing conditions and the operating conditions of the sheet manufacturing apparatus 100.

As described above, a sheet manufacturing apparatus 100 according to the first embodiment of the invention has a drum 41 that sieves first screened material MC, which is material containing fiber, and a first web former 45 that accumulates first screened material MC discharged from the drum 41. The sheet manufacturing apparatus 100 also has the parts of a sheet maker 102 that processes the first web W1, that is, the first screened material MC, accumulated in the first web former 45.

During processing by the processor, the sheet manufacturing apparatus 100 operates the mesh belt 46 of the first web former 45 at a target speed V1. When starting from a state in which the drum 41 is stopped (not turning), a startup operation including a state in which the mesh belt 46 operates at a faster speed than the target speed V1 during the speed adjustment period TE2 is executed. The processor may include any of the processes executed after the first web former 45, and may be selected from among any of the parts of the sheet maker 102, for example.

In a sheet manufacturing apparatus 100 applying the fiber processing device and control method of a fiber processing device according to the invention, the speed VA at which the mesh belt 46 operates during the speed adjustment period TE2 is greater than the target speed V1. As a result, even if the amount of first screened material MC discharged from the drum 41 increases briefly, an increase in the thickness of the first web W1 accumulated in the first web former 45 can be suppressed.

The sheet manufacturing apparatus 100 also maintains a state in which the first web former 45 operates at a greater speed than the target speed V1 during the speed adjustment period TE2. For example, a period in which speed VA is greater than target speed V1 is maintained in the examples shown in FIG. 9 to FIG. 11. Holding speed VA greater than target speed V1 when the amount of first screened material MC dropping from the drum 41 may easily increase can be expected to effectively suppress variation in the thickness of the first web W1 due to temporary variations in the amount of first screened material MC.

The first web former 45 also has a mesh belt 46 that an accumulate the first screened material MC in a sheet, and the mesh belt 46 moves in a circulating path defined by the tension rollers 47. Therefore, by setting the speed VA at which the mesh belt 46 moves faster than the target speed V1, variation in the thickness of the first web W1 accumulated on the mesh belt 46 can be suppressed.

During processing by the processor, the sheet manufacturing apparatus 100 drives the mesh belt 46 at a target speed V1, and in the speed adjustment period TE2, maintains the operating speed of the mesh belt 46 at a second speed that is faster than the target speed V1. This configuration can effectively suppress variation in the thickness of the first web W1 due to temporary variation in the amount of first screened material MC in the speed adjustment period TE2 because the mesh belt 46 operates at a higher speed than the target speed V1 for the speed VA when making sheets S.

When the sheet manufacturing apparatus 100 starts from a state in which the drum 41 is stopped, the operating speed of the mesh belt 46 may accelerate to a higher speed than the target speed V1 before the drum 41 starts turning. In this case, during a second period after acceleration ends, the first belt motor 47*b* continues driving the mesh belt 46 at a faster speed than target speed V1. Because the speed VA exceeds the target speed V1 during the time when the amount of first screened material MC dropping from the drum 41 increases easily, this configuration can effectively suppress variation in the thickness of the first web W1 due to temporary variations in the amount of first screened material MC.

When starting from a state in which the drum 41 is stopped, the sheet manufacturing apparatus 100 executes a startup operation when there is defibrated material MB inside the drum 41. Because speed VA thus exceeds the target speed V1 during the time when the amount of first screened material MC dropping from the drum 41 increases easily, this configuration can effectively suppress variation in the thickness of the first web W1 due to temporary variations in the amount of first screened material MC. By executing the normal startup sequence when the amount of first screened material MC dropping from the drum 41 does not vary easily, a drop in productivity manufacturing sheets S can be prevented.

The drum 41 is a round cylinder having openings formed in the outside surface of the drum 41, and configured to rotate on the axis of the cylinder. When the drum 41 starts turning with defibrated material MB inside the drum 41, the amount of first screened material MC that drops onto the mesh belt 46 when operation starts can fluctuate easily. Variation in the thickness of the first web W1 due to variation in the amount of first screened material MC can be suppressed in this configuration because a period in which the mesh belt 46 moves at a speed greater than the target speed V1 is maintained by the controller 150.

A sheet manufacturing apparatus 100 applying the fibrous feedstock recycling device of the invention has a defibrator 20 as a refiner that refines feedstock material MA containing fiber. The sheet manufacturing apparatus 100 also has a drum 41 that sieves the defibrated material MB refined by the refiner, and a first web former 45 as an accumulator that accumulates first screened material MC discharged from the drum 41. The sheet manufacturing apparatus 100 also has the parts of the sheet maker 102 as a processor that processes the first screened material MC accumulated on the first web former 45. While the sheet manufacturing apparatus 100 is making sheets S, the first web former 45 operates at a target speed V1. When the sheet manufacturing apparatus 100 starts from when the drum 41 is at a stop, a startup operation including a state in which the first web former 45 operates at a faster speed than the target speed V1 during the speed adjustment period TE2 after the drum 41 starts executes. As a result, an increase in the thickness of the first web W1 accumulated in the first web former 45 when the amount of first screened material MC moving from the drum 41 easily varies can be suppressed.

2. Embodiment 2

A second embodiment of the invention is described below.

The second embodiment describes an operation suppressing variation in the thickness of the first web W1 by the drive controller 152 controlling the speed VA of the mesh belt 46 and the speed VB of the drum 41 in the startup operation. The configuration of the sheet manufacturing apparatus 100 according to the second embodiment of the invention is the same as in the first embodiment, further description of the configuration of the sheet manufacturing apparatus 100 is omitted in the drawings and below.

In this second embodiment, the controller 150 executes the same operation shown in FIG. 6 as the first embodiment. In step ST7, the controller 150 controls the first belt motor 47*b* and first sieve motor 40*a* according to the operating conditions set in step ST1.

Figure 12:
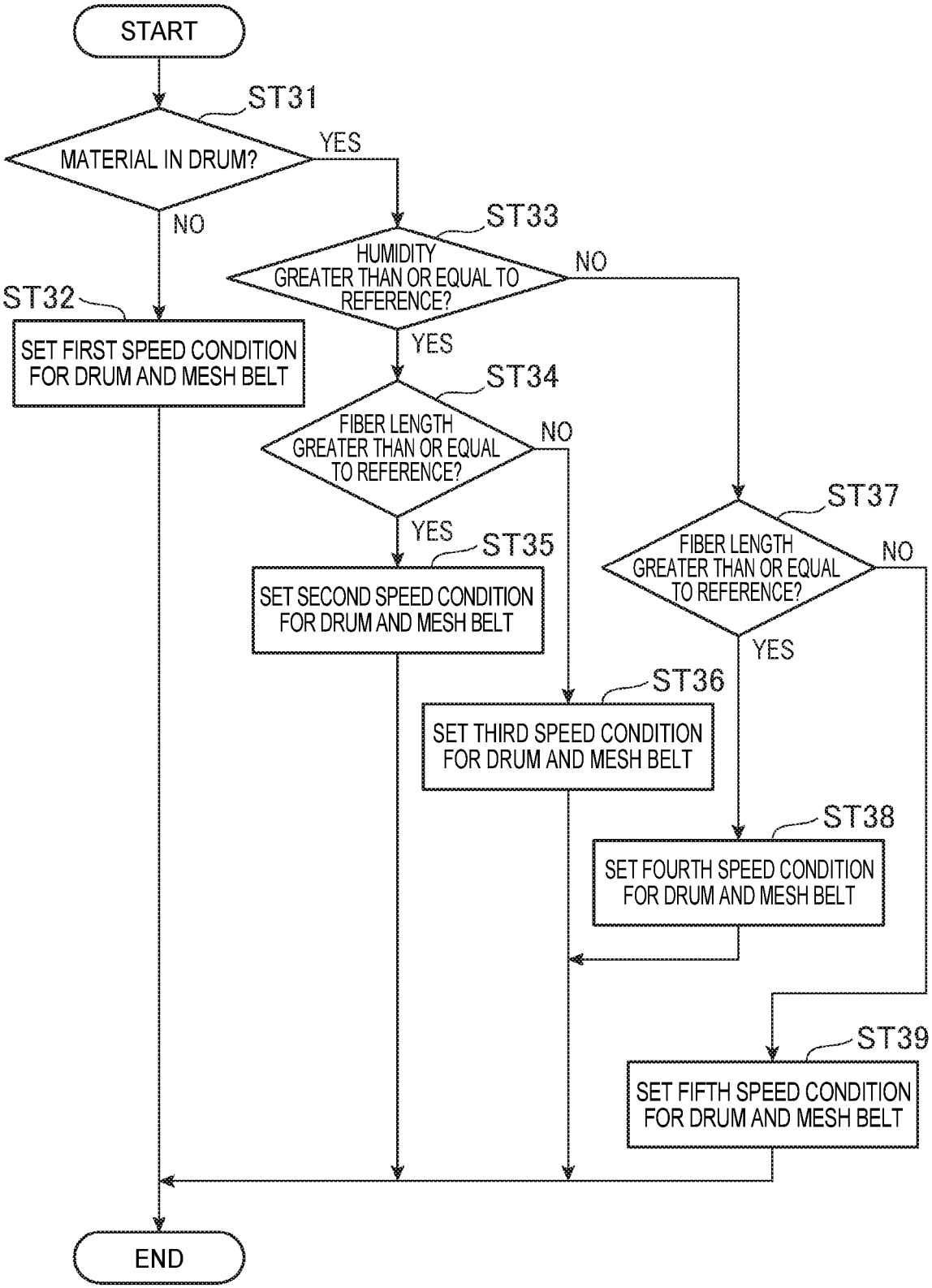
FIG. 12 is a flow chart of the operation of a sheet manufacturing apparatus according to the second embodiment of the invention.

FIG. 12 is a flow chart of the setup process executed in step ST1 in FIG. 6.

The setup process in the second embodiment also sets operating conditions related to controlling the first sieve motor 40*a*. The operating conditions set in the second embodiment include information relating to operation of the first belt motor 47*b*, and information relating to operation of the first sieve motor 40*a*. In the first embodiment, the first to fifth speed conditions include information related to the length of the speed adjustment period TE2, and information related to the maximum or minimum speed VA. The first to fifth speed conditions in the second embodiment include information related to the length of the acceleration time TE3 until speed VB reaches target speed V1 used when making sheets S.

In the setup process of FIG. 12, the controller 150 determines if there is defibrated material MB in the drum 41 (step ST31).

If there is no defibrated material MB inside the drum 41 (step ST31: NO), the controller 150 sets a first speed condition as the condition for accelerating the speed of the first sieve motor 40*a* and first belt motor 47*b* (step ST32), and ends the setup process.

If there is defibrated material MB in the drum 41 (step ST31: YES), the controller 150 determines whether or not the humidity detected by the first temperature/humidity detector 323 is greater than or equal to the reference value contained in the reference data 162 (step ST33). If the humidity is greater than or equal to the reference value (step ST33: YES), the controller 150 determines if the length of fiber contained in the defibrated material MB is greater than or equal to the reference value contained in the reference data 162 (step ST34).

If the length of fiber is greater than or equal to the reference value (step ST34: YES), the controller 150 sets a second speed condition as the condition for accelerating the speed of the first sieve motor 40*a* and first belt motor 47*b* (step ST35), and ends the setup process.

If the length of fiber is shorter than the reference value (step ST34: NO), the controller 150 sets a third speed condition as the condition for accelerating the speed of the first sieve motor 40*a* and first belt motor 47*b* (step ST36), and ends the setup process.

However, if the humidity is less than the reference value (step ST33: NO), the controller 150 determines if the length of fiber contained in the defibrated material MB is greater than or equal to the reference value contained in the reference data 162 (step ST37).

If the length of fiber is greater than or equal to the reference value (step ST37: YES), the controller 150 sets a fourth speed condition as the condition for accelerating the speed of the first sieve motor 40*a* and first belt motor 47*b* (step ST38), and ends the setup process.

If the length of fiber is shorter than the reference value (step ST37: NO), the controller 150 sets a fifth speed condition as the condition for accelerating the speed of the first sieve motor 40*a* and first belt motor 47*b* (step ST39), and ends the setup process.

Figure 13:
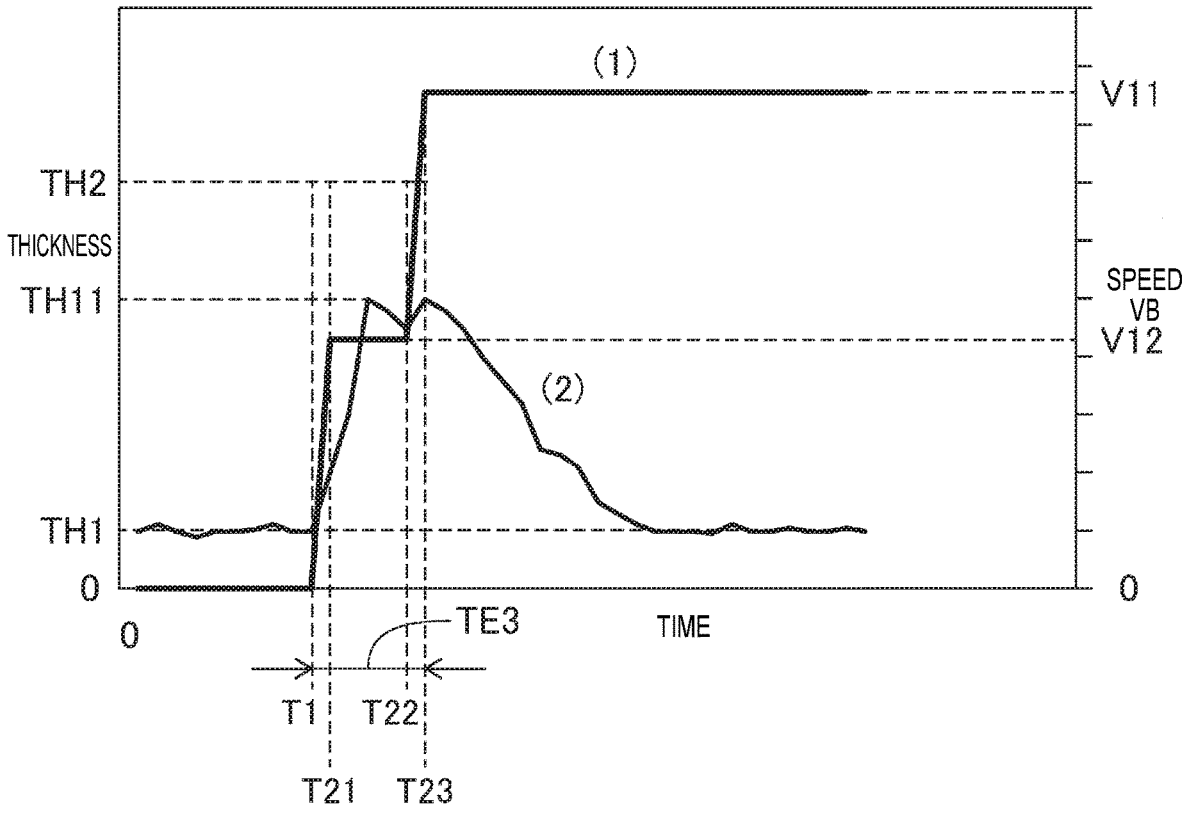
FIG. 13 is a graph showing an example of the relationship between the operating speed of the drum unit and change in the thickness of the first web.
Figure 14:
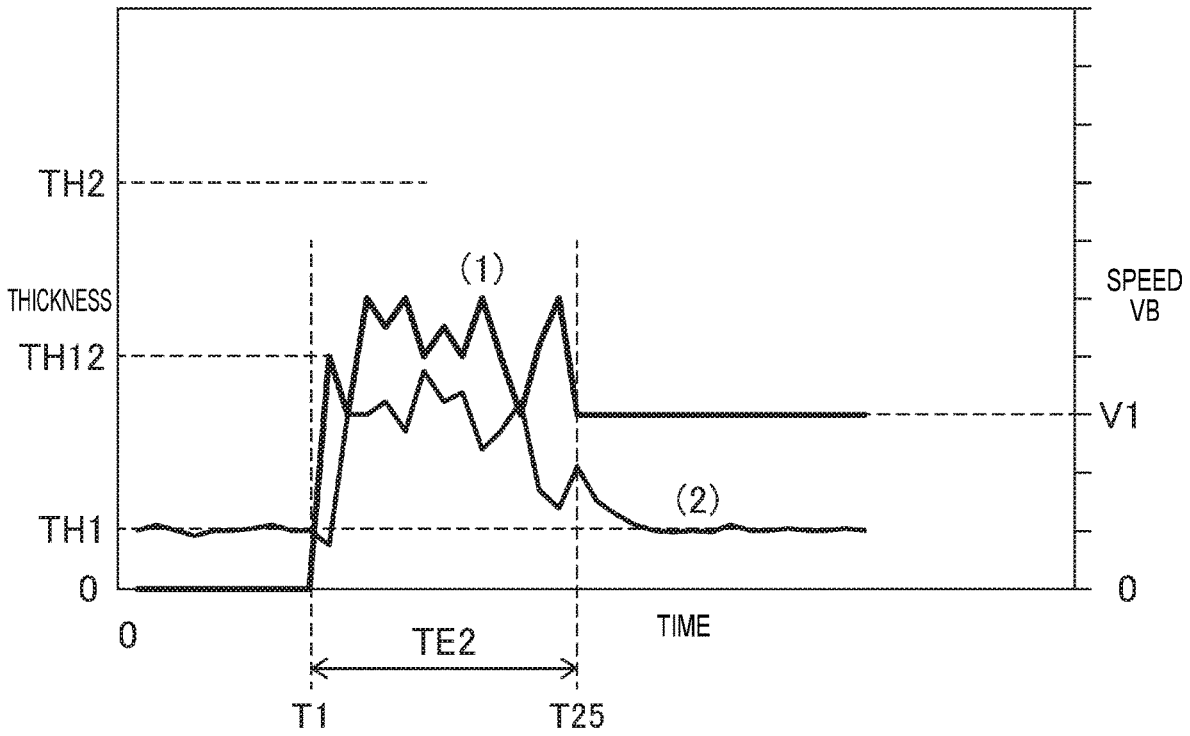
FIG. 14 is a graph showing an example of the relationship between the operating speed of the mesh belt and change in the thickness of the first web.

FIG. 13 is a graph showing the change in the speed VB of the drum 41 and the thickness of the first web W1, and shows an example of the operation when the second to fifth speed conditions are set in the setup process of FIG. 12. In FIG. 13 and FIG. 14, The Y-axis, X-axis, target speed V1, thickness TH1 and TH2, and time T1 are the same as in FIG. 8.

In FIG. 13, curve (1) indicates the speed VB detected by the first sieve speed detector 321, and (2) indicates the thickness of the first web W1. As described above, speed V11 is the speed VB when making sheets S, and in the startup operation, the controller 150 accelerates the first sieve motor 40*a* until the speed VB of the drum 41 reaches speed V11. Time T1 when acceleration of the first sieve motor 40*a* and first belt motor 47*b* starts is the same as in FIG. 8 and described above.

The time from when the controller 150 starts the first sieve motor 40*a* to when speed VB reaches speed V11 is period TE3. FIG. 13 shows an example of changing speed VB in steps, and more specifically is an example of changing speed VB in two steps. In period TE3, the controller 150 provides a period in which speed VB is held at an intermediate speed V12 that is below speed V11. More specifically, the controller 150 starts turning the first sieve motor 40*a* at time T1, and accelerates the first sieve motor 40*a* so that speed VB reaches intermediate speed V12 at time T21. The controller 150 then holds speed VB at intermediate speed V12 from time T21 to time T22, then accelerates the first sieve motor 40*a* again from time T22 to reach target speed V1 at time T23.

In the example in FIG. 13, the time T23 at which speed VB reaches target speed V11 is after time T2 described above. In other words, the controller 150 holds speed VB at a speed less than target speed V11 for period TE3 (from time T1 to time T23) after the first sieve motor 40*a* starts turning. As shown by (2) in FIG. 13, the value detected by the first thickness detector 324 fluctuates from approximately time T21, but the peak thickness TH11 of the first web W1 is less than the peak thickness TH2 shown in FIG. 8. This demonstrates that variation in the thickness of the first web W1 is suppressed.

The second to fifth speed conditions include information specifying the length of the acceleration time TE3, time T23, and speed VB in period TE3 (intermediate speed V12, for example), for controlling the first sieve motor 40*a*.

The controller 150 also executes the startup operation of the first belt motor 47*b* according to the second to fifth speed conditions. More specifically, the startup operation in the second embodiment includes controlling speed VA and controlling speed VB.

FIG. 14 is a graph showing an example of change in the speed VA of the mesh belt 46 and the thickness of the first web W1, and shows an example of when second to fifth speed conditions are set. In FIG. 14, line (1) indicates the speed VA detected by the first belt speed detector 322, and (2) indicates the thickness of the first web W1 detected by the first thickness detector 324.

In FIG. 14, the controller 150 controls the speed of the first belt motor 47*b* based on the detection value from the first thickness detector 324, that is, is an example of feedback control. In this example, the length of the speed adjustment period TE2 is set as an operating condition of the first belt motor 47*b*. The operating conditions of the first belt motor 47*b* may also include the minimum speed VA during the speed adjustment period TE2.

In the example in FIG. 14, the controller 150 starts accelerating the first belt motor 47*b*, and starts acquiring the detection value from the first thickness detector 324, at time T1. The controller 150 increases or decreases the speed of the first belt motor 47*b* according to the difference between the detection value from the first thickness detector 324 and a threshold value. The threshold value related to the detection value of the first thickness detector 324 may be thickness TH1, or another value included in the reference data 162.

In the example in FIG. 14, speed VA is greater than target speed V1 for at least part of the speed adjustment period TE2 (time T1 to time T25). The controller 150 decelerates the first belt motor 47*b* from time T11 so that the speed VA goes to target speed V1 at time T25 according to the length of the speed adjustment period TE2 defined by the speed conditions.

In the example in FIG. 14, the second to fifth speed conditions may contain little information, such as information indicating the length of the speed adjustment period TE2, which has the advantage of simplifying the process setting the second to fifth speed conditions.

The second to fifth speed conditions are not limited to the example shown in FIG. 14, and the examples shown in FIG. 9 and FIG. 10 can be used.

During processing by the processor, the sheet manufacturing apparatus 100 according to the second embodiment of the invention drives the drum 41 at a speed V11 to discharge material from the drum 41. When the sheet manufacturing apparatus 100 starts from a state in which the drum 41 is stopped, a sieve startup operation including a state in which the drum 41 operates at a different speed than the third speed during the speed adjustment period TE2 is executed. The sieve startup operation is an operation of controlling the speed of the drum 41 according to the speed conditions set in the setup process (FIG. 12) as shown in FIG. 13, for example.

By controlling both speed VA and speed VB, this configuration can adjust the amount of first screened material MC discharged from the drum 41, and the speed of the mesh belt 46, in the period when the amount of first screened material MC discharged from the drum 41 increases easily. As a result, variation in the thickness of the first web W1 can be more effectively suppressed.

3. Embodiment 3

A third embodiment of the invention is described next.

The first and second embodiments describe adjusting the speed VA of the mesh belt 46 and/or the speed VB of the drum 41 in the startup operation by the drive controller 152 controlling the first belt motor 47*b* and/or first sieve motor 40*a*.

In the third embodiment, the drive controller 152 adjusts the speed VD of the drum 61 by controlling the second belt motor 74*b* and/or second sieve motor 60*a* in the startup operation.

More specifically, the controller 150 applies the control of the first belt motor 47*b* described in the first embodiment to controlling the second belt motor 74*b*. The controller 150 also applies control of the first sieve motor 40*a* and first belt motor 47*b* described in the second embodiment to controlling the second sieve motor 60*a* and second belt motor 74*b*.

In the third embodiment, the drum 61 is an example of a sieve, the second sieve motor 60*a* is an example of a sieve driver, the second web former 70 is an example of an accumulator, and the mesh belt 72 is an example of a receiver. The second belt motor 74*b* is also an example of a driver, and the second temperature/humidity detector 333 is an example of a humidity detector.

3-1. Second Web Forming Conditions

The conditions for forming the second web W2 formed by the second web former 70 are described below with reference to FIG. 3.

The thickness of the second web W2 is determined by the amount of mixture MX, which is the material supplied to the mesh belt 72, and the amount of movement of the mesh belt 72 per unit time. The amount of movement of the mesh belt 72 per unit time is speed VC.

One factor determining the amount of mixture MX supplied to the mesh belt 72, that is, the amount of mixture MX passing through the openings 61*a*, is speed VD. As speed VD increases, the mixture MX is more quickly detangled in the drum 61, and the mixture MX passes more easily through the openings 61*a*. In addition, the greater the speed VD, the more easily the mixture MX passes the openings 61*a*. Therefore, the amount of mixture MX passing the openings 61*a* increases as the speed VD increases.

The amount of mixture MX passing the openings 61*a* changes when the drum 61 starts operating from a stop. Because rotation of the drum 61 produces friction between the fibers of the mixture MX inside the drum 61, the mixture MX also becomes charged. If the mixture MX clumps due to this static electricity, it becomes more difficult for the mixture MX to pass the openings 61*a*. On the other hand, when the drum 61 is stopped, the charge of the charged mixture MX is discharged, and clumps of fiber in the mixture MX break apart. Therefore, when the drum 61 starts turning from a stop, that is, when the drum 61 starts operating, that is, during startup, the amount of mixture MX passing the openings 61*a* temporarily increases.

The amount of mixture MX passing the openings 61*a* is also affected by the humidity in the drum 61. Humidity as used here can be referred to as relative humidity (RH). If the humidity inside the drum 61 is low, the mixture MX becomes charged and fibers clump easily. Therefore, the lower the humidity inside the drum 61, and the drum 61 starts turning from a stop, that is, during startup, the amount of mixture MX passing the holes 61*a* temporarily increases.

The amount of mixture MX passing the openings 61*a* also varies according to the length of the fiber in the mixture MX. Short fibers pass through the openings 61*a* easily. Therefore, the shorter the fibers in the mixture MX, the greater the amount of mixture MX that passes the openings 61*a*.

In other words, the greatest factor determining the amount of mixture MX supplied from the drum 61 to the mesh belt 72 is the speed VD of the drum 61. Factors that change the amount of mixture MX include whether or not the drum 61 is starting up, the humidity inside the drum 61, and the length of fiber in the mixture MX.

If the thickness of the second web W2 varies, the amount of material supplied to processes downstream from the second web former 70 may vary, affecting the quality of the sheets S manufactured by the sheet manufacturing apparatus 100.

The controller 150 of the sheet manufacturing apparatus 100 therefore executes a control process that suppresses variation in the thickness of the second web W2.

To execute control related to the thickness of the second web W2, the controller 110 can acquire the detection value output from the second thickness detector 334. As shown in FIG. 4, the controller 110 can also control the speed of the second sieve motor 60*a* and second belt motor 74*b*.

3-2. Sheet Manufacturing Apparatus Operation

The controller 150 first executes the operation shown in FIG. 6 by drive controller 152. In the setup process of step ST1, the controller 150 configures settings related to the operation of the second belt motor 74*b*. In this case, in the setup process shown in FIG. 7, the controller 150 sets the speed VC of the mesh belt 72 according to the first to fifth speed conditions. The first embodiment applied the first to fifth speed conditions to speed VA, but the first to fifth speed conditions can also be applied to speed VC.

In the setup process of step ST1, the controller 150 also configures settings related to the operation of the second sieve motor 60*a* and second belt motor 74*b*. In this case, the controller 150 sets the first to fifth speed conditions for speed VD of the drum 61 and speed VC of the mesh belt 72 in the setup process in FIG. 12.

The controller 150 applies the setup processes in FIG. 7 and FIG. 12 to speed VC, or to speed VC and speed VD. The first to fifth speed conditions are basic conditions for increasing speed VD from zero when the drum 61 starts operating, and include a target speed for the second sieve motor 60*a*, and the time or the acceleration rate of the second sieve motor 60*a* to the target speed.

Control related to starting speed VC may use the patterns shown in FIG. 9 to FIG. 11 and FIG. 14. More specifically, the data shown in these figures may be used as the data related to setting speed VC by substituting speed VA indicated by the line (1) for speed VC based on the detection values from the second belt speed detector 332. In addition, the data shown in FIG. 13 may be used as data related to the speed of speed VD by substituting speed VB for speed VD based on the detection value from the second sieve speed detector 331.

The target speed V1 of speed VC may be the same as target speed V1 of speed VA, or different.

The speed adjustment period in the second to fifth speed conditions may be understood as the speed adjustment period related to speed VC. This also applies to the acceleration time of speed VB. The relationship between the length of the speed adjustment period in each of the speed conditions, and the maximum speed VC in the speed adjustment period, are also as described in the first and second embodiments.

The first to fifth speed conditions related to speed VC may be the same as the first to fifth speed conditions described in the first embodiment, or first to fifth speed conditions optimized for the operation of the drum 61 may be used. This also applies to the first to fifth speed conditions set for speed VD.

In the third embodiment, the controller 150 suppresses variation in the thickness of the second web W2 by controlling the speed VC of the mesh belt 72 when the amount of mixture MX dropping from the drum 61 to the mesh belt 72 increases temporarily. As a result, in the sheet S manufacturing process of the sheet manufacturing apparatus 100, the amount of mixture MX supplied to processes downstream from the second web former 70 can be stabilized, and variation in the quality of the sheet S can be suppressed. The burden of making manual adjustments to suppress variation in the quality of the sheet S can also be reduced.

A sheet manufacturing apparatus 100 applying the fiber processing device and control method of a fiber processing device according to the third embodiment of the invention has a drum 61 that sieves mixture MX, which is material containing fiber, and a second web former 70 for accumulating mixture MX discharged from the drum 61. The sheet manufacturing apparatus 100 also has the parts of a processor that processes the second web W2 accumulated on the mesh belt 72, that is, the mixture MX. The processor may include any process downstream from the second web former 70, such as the sheet former 80 or sheet cutter 90.

During processing by the processor, the sheet manufacturing apparatus 100 operates the mesh belt 72 at a target speed V1. When starting with the 61 stopped, the sheet manufacturing apparatus 100 executes a startup operation including a state in which the mesh belt 72 travels faster than the target speed V1 during a speed adjustment period after the drum 61 starts. As a result, even if the amount of mixture MX discharged from the drum 61 increases temporarily, an increase in the thickness of the second web W2 accumulated on the second web former 70 can be suppressed. The amount of mixture MX supplied to processes downstream from the second web former 70 while the sheet manufacturing apparatus 100 manufactures sheets S can be stabilized. For example, variation in the quality of the sheet S can be suppressed, and the burden of making manual adjustments to stabilize the quality of the sheet S can also be reduced.

During the speed adjustment period, the sheet manufacturing apparatus 100 also maintains a state in which the mesh belt 72 operates at a higher speed than the target speed V1. As a result, because speed VC is held at a speed faster than the target speed V1 during the period when the amount of mixture MX falling from the drum 61 increases easily, variation in the thickness of the second web W2 due to variation in the amount of mixture MX can be effectively suppressed.

The second web former 70 has a mesh belt 72 on which the mixture MX can be accumulated in a sheet, and the mesh belt 72 moves in a circulating path defined by the tension rollers 74. Therefore, by setting the speed VC at which the mesh belt 72 moves faster than the target speed V1, variation in the thickness of the second web W2 accumulated on the mesh belt 72 can be suppressed.

During processing by the processor, the sheet manufacturing apparatus 100 drives the mesh belt 72 at a target speed V1, and in the speed adjustment period, maintains the operating speed of the mesh belt 72 at a second speed that is faster than the target speed V1. This configuration can effectively suppress variation in the thickness of the second web W2 due to temporary variation in the amount of mixture MX in the speed adjustment period because the mesh belt 72 operates at a higher speed than the target speed V1 for the speed VC when making sheets S.

When the sheet manufacturing apparatus 100 starts from a state in which the drum 61 is stopped, the operating speed of the mesh belt 72 may accelerate to a higher speed than the target speed V1, and in a second period after acceleration ends, the mesh belt 72 is held at an operating speed greater than the target speed V1. Because the speed VC exceeds the target speed V1 during the time when the amount of mixture MX dropping from the drum 61 increases easily, this configuration can effectively suppress variation in the thickness of the second web W2 due to variations in the amount of mixture MX.

When starting from a state in which the drum 61 is stopped, the sheet manufacturing apparatus 100 may execute the startup operation when there is mixture MX inside the drum 61. Because speed VC thus exceeds the target speed V1 during the time when the amount of mixture MX dropping from the drum 61 increases easily, this configuration can effectively suppress variation in the thickness of the second web W2 due to variation in the amount of mixture MX. By executing the normal startup sequence when the amount of mixture MX dropping from the drum 61 does not vary easily, a drop in productivity manufacturing sheets S can be prevented.

The drum 61 is a round cylinder having openings formed in the outside surface of the drum 61, and configured to rotate on the axis of the cylinder. When the drum 61 starts turning with m×m inside the drum 61, the amount of mixture MX that drops onto the mesh belt 72 when operation starts can fluctuate easily. Variation in the thickness of the second web W2 due to variation in the amount of mixture MX can be suppressed in this configuration because a period in which the mesh belt 72 moves at a speed greater than the target speed V1 is maintained by the controller 150.

Control of the first sieve motor 40*a* as described in the second embodiment can also be applied to controlling the second sieve motor 60*a*. More specifically, control of the speed of the drum 41 can be applied to controlling the speed of drum 61. When the sheet manufacturing apparatus 100 starts from a state in which the drum 61 is stopped, a sieve startup operation including a state in the speed adjustment period in which the drum 61 operates at a different speed than the speed V11 during sheet S production is executed. In this case, by controlling both speed VC and speed VD, the amount of mixture MX discharged to the mesh belt 72, and the speed of the mesh belt 72, can be adjusted in the period in which the amount of mixture MX falling from the drum 61 may increase easily. As a result, variation in the thickness of the second web W2 can be more effectively suppressed.

4. Other Embodiments

The embodiments described above are only examples of specific embodiments of the invention as described in the accompanying claims, do not limit the invention, and can be varied in many ways as described below without departing from the scope and spirit of the invention as described in the accompanying claims.

The foregoing first embodiment describes the controller 150 applying the setup process in FIG. 7 to controlling the speed of the mesh belt 46, and starting the mesh belt 46 and drum 41 in step ST7 based on the speed conditions that are set.

The foregoing second embodiment describes the controller 150 executing the setup process shown in FIG. 12, and starting the mesh belt 46 and drum 41 in step ST7 based on the speed conditions that are set.

The foregoing third embodiment describes the controller 150 executing the setup processes in FIG. 7 and FIG. 12 to control the speed of the mesh belt 72, or control the speed of the mesh belt 72 and the drum 61.

The invention is not so limited, however, and the controller 150 may execute the setup process in FIG. 7 to control the speed of both mesh belt 46 and mesh belt 72. The controller 150 may also execute the setup process of FIG. 12 on each of drums 41, 61 and mesh belts 46, 72. In other words, the controller 150 may apply the control method of the invention to the speed VA of the mesh belt 46, the speed VB of the drum 41, the speed VC of mesh belt 72, and speed VD of drum 61. In this case, the controller 150 also controls the first sieve motor 40*a*, second sieve motor 60*a*, first belt motor 47*b*, and second belt motor 74*b*.

The foregoing embodiments describe the mesh belt 46 and the mesh belt 72 as foraminous mesh belts functioning as accumulators. However, the invention is not so limited, and belts without openings, or flat panels, may be used as the accumulator.

The sieves are also not limited to drum-shaped drums 41, 61. For example, a cylindrical sieve with openings may be used as the sieve.

The location of the first temperature/humidity detector 323 in the foregoing embodiments is also not limited to inside the drum 41, and may be inside the housing 43, for example. Likewise, the second temperature/humidity detector 333 is not limited to being disposed inside the drum 61, and may be located inside the housing 63.

A temperature sensor or a sensor for detecting the moisture content of the feedstock material MA may be disposed to the feedstock feeder 10, in which case the controller 150 can estimate the humidity inside the drum 41 and inside the drum 61 based on the detected temperature and/or moisture content of the feedstock material MA. A temperature/humidity sensor may also be disposed in conduit 2 and conduit 3, and configured to detect the temperature and/or humidity before and after the defibrator 20. In this case, the controller 150 can estimate the humidity inside the drum 41 and inside the drum 61 based on the change in the detected temperature and/or moisture content before and after processing by the defibrator 20. A temperature/humidity sensor may also be disposed to detect the temperature and/or humidity inside the housing of the sheet manufacturing apparatus 100. □

When the invention is applied to the air-laying device 60 and second web former 70 in the third embodiment, a classifier that selects and separates the defibrated material MB into first screened material MC, second screened material, and third screened material D may be provided instead of classifier 40. This classifier may be a cyclone classifier, elbow-jet classifier, or eddy classifier, for example.

The specific configurations whereby the drive controller 152 controls the speed of the first sieve motor 40*a*, second sieve motor second sieve motor 60*a*, first belt motor 47*b*, and second belt motor 74*b* are also not specifically limited, and, for example, may be configured to vary the voltage of the drive current supplied to the motors, or control the speed by other methods.

The sheet manufacturing apparatus 100 is also not limited to manufacturing sheets S, and may be configured to make rigid sheets or paperboard comprising laminated sheets, or other web products. The manufactured product is also not limited to paper, and may be nonwoven cloth. The properties of the sheets S are also not specifically limited, and may be paper products that can be used as recording, writing, or printing on (such as copier paper, plain paper); wall paper, packaging paper, color paper, drawing paper, or bristol paper. When the sheet S is nonwoven cloth, it may be common nonwoven cloth, fiber board, tissue paper, kitchen paper, vacuum filter bags, filters, liquid absorption materials, sound absorption materials, cushioning materials, or mats.

The foregoing embodiments describe a sheet manufacturing apparatus 100 that acquires material by defibrating feedstock in air, and makes sheets S using this material and resin, as an example of a fiber processing device and fibrous feedstock recycling device according to the invention. However, application of the invention is not limited to such a device, however, and can be applied to a wet process sheet manufacturing apparatus that creates a solution or slurry of feedstock containing fiber in water or other solvent, and processes the feedstock into sheets. The invention can also be applied to an electrostatic sheet manufacturing apparatus that causes material containing fiber defibrated in air to adhere to the surface of a drum by static electricity, for example, and then processes the feedstock adhering to the drum into sheets.□

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A fiber processing device comprising:

a sieve having a plurality of first openings and configured to rotate and screen material containing fiber, the screened material being discharged through the plurality of first openings;

an accumulator configured to accumulate the material discharged from the sieve, the accumulator including a mesh belt having a plurality of second openings, wherein components of the material discharged from the sieve that are larger than the plurality of second openings in the mesh belt accumulate on the mesh belt;

a processor configured to process the material accumulated on the mesh belt; and a controller comprising a central processing unit (CPU), the controller being programmed to control the accumulator to operate at a first speed during processing by the processor, wherein when starting from a state in which the sieve is stopped, the controller is programmed to execute a startup operation including a state in which the controller is programmed to control the accumulator to operate at a higher speed than the first speed in a first period after the sieve starts, in the first period, the accumulator is configured to maintain a state of operating at a higher speed than the first speed, and when starting from a state in which the sieve is stopped, before the sieve starts, an operating speed of the accumulator is configured to accelerate to a higher speed than the first speed, and in a second period after acceleration ends, a state in which the accumulator is configured to operate at a higher speed than the first speed is maintained.

2. The fiber processing device described in claim 1, wherein the accumulator has a receiver on which the material can accumulate in a sheet, and the receiver is configured to move on a circulating path.

3. The fiber processing device described in claim 1, wherein during processing by the processor, the accumulator is configured to operate at the first speed, and in the first period, the accumulator is configured to maintain a state of operating at a second speed that is greater than the first speed.

4. The fiber processing device described in claim 1, wherein when starting from a state in which the sieve is stopped, the startup operation executes with the material in the sieve.

5. The fiber processing device described in claim 1, wherein the sieve is a cylinder, the plurality of first openings are disposed in an outside surface of the sieve, and the sieve is configured to rotate on an axis of the cylinder.

6. A fibrous feedstock recycling device comprising:

a refiner configured to refine material containing fiber;

a sieve having a plurality of first openings and configured to rotate and screen refined material acquired from the refiner, the screened refined material being discharged through the plurality of first openings;

an accumulator configured to accumulate the refined material discharged from the sieve, the accumulator including a mesh belt having a plurality of second openings, wherein components of the material discharged from the sieve that are larger than the plurality of second openings in the mesh belt accumulate on the mesh belt;

a processor configured to process the refined material accumulated on the mesh belt; and a controller comprising a central processing unit (CPU), the controller being programmed to control the accumulator to operate at a first speed during processing by the processor, wherein when starting from a state in which the sieve is stopped, the controller is programmed to execute a startup operation including a state in which the controller is programmed to control the accumulator to operate at a higher speed than the first speed in a first period after the sieve starts, in the first period, the accumulator is configured to maintain a state of operating at a higher speed than the first speed, and when starting from a state in which the sieve is stopped, before the sieve starts, an operating speed of the accumulator is configured to accelerate to a higher speed than the first speed, and in a second period after acceleration ends, a state in which the accumulator is configured to operate at a higher speed than the first speed is maintained.

7. A fiber processing device comprising:

a sieve having a plurality of first openings and configured to rotate and screen material containing fiber, the screened material being discharged through the plurality of first openings;

an accumulator configured to accumulate the material discharged from the sieve, the accumulator including a mesh belt having a plurality of second openings, wherein components of the material discharged from the sieve that are larger than the plurality of second openings in the mesh belt accumulate on the mesh belt, the accumulator including a receiver on which the material can accumulate in a sheet, the receiver moving on a circulating path;

a processor configured to process the material accumulated on the mesh belt;

a driver configured to operate the accumulator to convey the material accumulated on the accumulator to the processor; and a controller comprising a central processing unit (CPU), the controller being programmed to control the accumulator to operate at a first speed during processing by the processor, wherein when starting from a state in which the sieve is stopped, the controller is programmed to execute a startup operation including a state in which the controller is programmed to control the accumulator to operate at a higher speed than the first speed in a first period after the sieve starts, in the first period, the accumulator is configured to maintain a state of operating at a higher speed than the first speed, and when starting from a state in which the sieve is stopped, before the sieve starts, an operating speed of the accumulator is configured to accelerate to a higher speed than the first speed, and in a second period after acceleration ends, a state in which the accumulator is configured to operate at a higher speed than the first speed is maintained.

* * * * *